US009996051B2

(12) United States Patent
Sato et al.

(10) Patent No.: US 9,996,051 B2
(45) Date of Patent: Jun. 12, 2018

(54) IMAGE FORMING APPARATUS AND CARTRIDGE

(71) Applicant: CANON KABUSHIKI KAISHA, Tokyo (JP)

(72) Inventors: Masaaki Sato, Yokohama (JP); Masatoshi Yamashita, Kawasaki (JP); Toshiharu Kawai, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 54 days.

(21) Appl. No.: 15/292,401

(22) Filed: Oct. 13, 2016

(65) Prior Publication Data

US 2017/0031313 A1 Feb. 2, 2017

Related U.S. Application Data

(62) Division of application No. 14/877,029, filed on Oct. 7, 2015, now Pat. No. 9,494,915, which is a division (Continued)

(30) Foreign Application Priority Data

Nov. 1, 2011 (JP) ..... 2011-240226

(51) Int. Cl.
*G03G 21/18* (2006.01)
*G03G 15/02* (2006.01)
*G03G 21/16* (2006.01)

(52) U.S. Cl.
CPC ..... *G03G 21/1842* (2013.01); *G03G 15/0216* (2013.01); *G03G 21/1647* (2013.01); (Continued)

(58) Field of Classification Search
CPC ..... G03G 21/1842
See application file for complete search history.

(56) References Cited

U.S. PATENT DOCUMENTS 4,754,302 A 6/1988 Komatsubara
5,053,820 A 10/1991 Preszler
(Continued)

FOREIGN PATENT DOCUMENTS

EP 1 816 527 A2 8/2007
JP 05-173375 A 7/1993
(Continued)

OTHER PUBLICATIONS

European Search Report dated Aug. 28, 2017, in related European Patent Application No. 12188613.9.
(Continued)

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

A cartridge detachably mountable to an image forming apparatus including a main assembly and a detachably supported supporting member movable between a first position where the cartridge is provided at an image formable position, and a second position retracted from the first position. The cartridge includes a supported portion for being supported by contacting with a supporting portion provided in the supporting member when the supporting member is in the second position, and a suppressed portion for suppressing rotation of the cartridge about the supported portion by engaging with a suppressing portion in the supporting member when the supporting member is in the second position. When the supporting member is at the first position, the supported portion is spaced from the supporting portion and the suppressed portion is spaced from the suppressing portion.

4 Claims, 22 Drawing Sheets

Related U.S. Application Data of application No. 14/493,691, filed on Sep. 23, 2014, which is a division of application No. 13/650,453, filed on Oct. 12, 2012, now Pat. No. 8,862,022.

(52) U.S. Cl.
CPC ..... *G03G 21/1676* (2013.01); *G03G 21/18* (2013.01); *G03G 21/1803* (2013.01); *G03G 21/1661* (2013.01); *G03G 2221/1684* (2013.01); *G03G 2221/1869* (2013.01)

(56) References Cited

U.S. PATENT DOCUMENTS

| | | | | |
|---|---|---|---|---|
| 5,182,608 | A | 1/1993 | Kroll | |
| 5,303,018 | A * | 4/1994 | Terada | G03G 15/0131 347/116 |
| 6,792,229 | B2 | 9/2004 | Matsuzaki | |
| 6,980,758 | B2 | 12/2005 | Murayama et al. | |
| 7,158,736 | B2 | 1/2007 | Sato et al. | |
| 7,340,197 | B2 | 3/2008 | Murayama et al. | |
| 7,567,769 | B2 | 7/2009 | Noguchi et al. | |
| 7,664,428 | B2 | 2/2010 | Kei | |
| 7,715,746 | B2 | 5/2010 | Tanabe | |
| 7,856,192 | B2 | 12/2010 | Koishi et al. | |
| 7,907,866 | B2 | 3/2011 | Imaizumi et al. | |
| 8,036,572 | B2 * | 10/2011 | Maeda | G03G 21/1853 399/116 |
| 8,060,003 | B2 | 11/2011 | Yoshizawa | |
| 8,204,404 | B2 | 6/2012 | Kawai | |
| 8,290,395 | B2 | 10/2012 | Uchida | |
| 8,452,208 | B2 | 5/2013 | Kikuchi | |
| 8,526,841 | B2 | 9/2013 | Koishi et al. | |
| 8,577,277 | B2 | 11/2013 | Yoshizawa | |
| 8,755,718 | B2 * | 6/2014 | Ushiozu | G03G 15/04054 399/110 |
| 8,768,210 | B2 * | 7/2014 | Hoashi | G03G 21/1853 399/110 |
| 8,862,022 | B2 | 10/2014 | Sato et al. | |
| 2008/0159772 | A1 | 7/2008 | Koishi et al. | |
| 2009/0092412 | A1 | 4/2009 | Kei | |
| 2009/0290904 | A1 | 11/2009 | Kawai | |
| 2009/0290905 | A1 | 11/2009 | Mizuno | |
| 2010/0080622 | A1 | 4/2010 | Uchida | |
| 2011/0116833 | A1 | 5/2011 | Maeda et al. | |
| 2011/0123223 | A1 | 5/2011 | Koishi et al. | |
| 2011/0305480 | A1 | 12/2011 | Tanaami et al. | |
| 2012/0039624 | A1 | 2/2012 | Uchida et al. | |
| 2012/0195627 | A1 | 8/2012 | Kikuchi | |
| 2012/0207511 | A1 | 8/2012 | Sato | |
| 2012/0308264 | A1 | 12/2012 | Kikuchi | |
| 2012/0328331 | A1 | 12/2012 | Sato | |

FOREIGN PATENT DOCUMENTS

| | | | |
|---|---|---|---|
| JP | 2008-292804 | A | 12/2008 |
| JP | 2010-102304 | A | 5/2010 |
| JP | 2010-266854 | A | 11/2010 |
| KR | 10-2008-0063017 | A | 7/2008 |
| RU | 2289835 | C2 | 12/2006 |
| RU | 2367016 | C2 | 9/2009 |

OTHER PUBLICATIONS

Russian Notice of Allowance dated May 5, 2014, in related Russian Patent Application No. 2012146552 (with English translation).
Chinese Office Action dated Nov. 3, 2013, in related Chinese Patent Application No. 201210430079.2 (with English translation).
Korean Notice of Allowance dated Nov. 19, 2014, in related Korean Patent Application No. 10-2012-0119294.
Japanese Office Action dated Sep. 29, 2015, in related Japanese Patent Application No. 2011-240226.
Russian Notice of Allowance dated Feb. 22, 2017, in Russian Patent Application No. 2015151799 (with English translation).

* cited by examiner (a)

(b)

(a)

(b)

(a)

(b)

(a)

(b)

IMAGE FORMING APPARATUS AND CARTRIDGE

This application is a divisional of application Ser. No. 14/877,029, filed Oct. 7, 2015, which is a divisional of application Ser. No. 14/493,691, filed Sep. 23, 2014, now abandoned, which is a divisional application Ser. No. 13/650,453, filed Oct. 12, 2012, now U.S. Pat. No. 8,862,022, issued Oct. 14, 2014.

FIELD OF THE INVENTION AND RELATED ART

The present invention relates to an image forming apparatus for forming an image on a recording material (medium), to which a plurality of cartridges are detachably mountable, and relates to the cartridges.

The image forming apparatus forms the image on the recording material by using an image forming process such as an electrophotographic process, an electrostatic recording process or a magnetic recording process. Examples of the image forming apparatus may include a copying machine, a printer (LED printer, laser beam printer or the like), a facsimile machine, a word processor and a multi-function machine of the these machines. The recording material is a material on which the image is formed by the image forming apparatus, and it is a paper sheet, an OHT sheet, a label or the like.

For example, the cartridge is a process cartridge or a developing cartridge, and in a state in which it is detachably mountable to an apparatus main assembly of the image forming apparatus, it contributes to an image forming process for forming the image on the recording material. The apparatus main assembly refers to an apparatus constituent portion excluding the cartridge from the constitution of the image forming apparatus.

The process cartridge is prepared by integrally assembling an image bearing member on which a latent image to be formed and at least one of a charging means, a developing means, a cleaning means as process means acting on the image bearing member, into a cartridge, and is detachably mountable to the apparatus main assembly. The image bearing member is an electrophotographic photosensitive member in an electrophotographic process, an electrostatic recording dielectric member in an electrostatic recording process, a magnetic recording magnetic member in a magnetic recording process, and the like. The process cartridge can be mounted to and demounted from the apparatus main assembly by a user himself or herself. For this reason, the maintenance of the apparatus main assembly can be easily performed.

Therefore, the process cartridge includes a cartridge prepared by integrally assembling the image bearing member and the developing means as the process means and being detachably mountable to the apparatus main assembly. The process cartridge which includes the image bearing member and the developing means integrally is called an integral type. Further, the process cartridge which includes the image bearing member and the process means other than the developing means integrally is called the discrete type. That is, the developing means is provided in a developing unit separated from the process cartridge, and the process cartridge, for forming the image, paired up with the developing unit is referred to as the so-called discrete type.

Further, the developing cartridge includes a developing roller (developer carrying member) and accommodates a developer (toner) used, by the developing roller for developing the latent image formed on the image bearing member, and is detachably mountable to the apparatus main assembly. Also the developing cartridge is detachably mountable to the apparatus main assembly by the user himself (herself). For that reason, the maintenance of the apparatus main assembly can be easily performed.

In the case of the developing cartridge, the image bearing member is mounted to the apparatus main assembly or a cartridge supporting member. Or, the image bearing member is provided in the so-called discrete type process cartridge (in this case, the process cartridge does not include the developing means).

Therefore, as for the cartridge, the integral type process cartridge and the discrete type process cartridge are included. Further, the cartridge includes the case where the discrete type process cartridge and the developing cartridge are used in a pair. Further, the cartridge includes the case where the developing cartridge, in which the image bearing member is fixed to the apparatus main assembly or the cartridge supporting member, which is actable on the image bearing member and is detachably mountable to the image bearing member. Further, the cartridge includes a developer cartridge which accommodates the developer (toner) to be supplied to the process cartridge, the developing cartridge, or the like.

For convenience, the electrophotographic image forming apparatus such as the printer using the electrophotographic process will be described as an example. The electrophotographic photosensitive member which is the image bearing member is electrically charged uniformly and is subjected to selective exposure to light to form the latent image. Then, the latent image is developed with the developer, thus being visualized as a developer image. The developer image is transferred onto the recording material. The transferred developer image is subjected to application of heat and pressure to be fixed as a fixed image on the recording material, so that the image is recorded (formed).

Such an electrophotographic image forming apparatus was subjected to developer supply or maintenance of various process means. As a means for facilitating the developer supply operation or the maintenance, all or a part of the electrophotographic photosensitive member, the charging means, the developing means, the cleaning means and the like is integrally assembled into a cartridge in a frame. Further, a cartridge type in which this cartridge is detachably mountable to the apparatus main assembly of the electrophotographic image forming apparatus is employed.

According to this cartridge type, the maintenance of the apparatus can be performed by a user himself (herself), so that operativity could be remarkably improved. Therefore, the cartridge type has been widely used in the electrophotographic image forming apparatus.

Here, there is the electrophotographic image forming apparatus in which the plurality of cartridges are provided and arranged in the substantially horizontal direction. In order to facilitate demounting and mounting of the cartridges with respect to the electrophotographic image forming apparatus, a constitution for integrally pulling out the plurality of cartridges has been proposed (Japanese Laid-Open Patent Application (JP-A) Hei 5-173375). In this constitution, a supporting member which is a movable member capable of being inserted into and being pulled out from the electrophotographic image forming apparatus is provided and the plurality of cartridges are mounted on the supporting member.

Further, in order to regulate a position of a cartridge in an apparatus main assembly, there is a constitution in which a supporting member is provided with a rotation preventing (regulating) portion and the cartridge is provided with a rotation preventing boss (JP-A 2008-292804). In this constitution, the rotation preventing portion provided to the supporting member and the rotation preventing boss of the cartridge are engaged with each other, so that the position of the cartridge in the apparatus main assembly is regulated.

The present invention provides a further development of the above-described prior art. That is, in the conventional constitutions, a position regulating portion for the cartridge was provided to the supporting member which is the movable member. For that reason, in order to effect positioning of the cartridge in the apparatus main assembly with high accuracy, there was a need to effect positioning of the supporting member (relative) to the apparatus main assembly with high accuracy. Further, there was a need to control a dimension of the supporting member with high accuracy, and particularly, this was met by use of a metal plate as a material for a part for forming the rotation preventing portion of the supporting member. This is because the plate metal can be processed in general with a degree of accuracy higher than that of a resin material. However, as a result, a cost was increased.

SUMMARY OF THE INVENTION

A principal object of the present invention is to provide an image forming apparatus and a cartridge which are capable of effecting positioning of the cartridge to an apparatus main assembly with high accuracy and at a low cost.

According to an aspect of the present invention, there is provided an image forming apparatus for forming an image on a recording material, comprising: a supporting member for supporting a plurality of cartridges, wherein said supporting member is movable to an outside position to which said supporting member is capable of being pulled out of a main assembly of said image forming apparatus and where the cartridges are detachably mountable to the supporting member, a first inside position where the cartridges are positioned to the main assembly in an inside of the main assembly, and a second inside position where the supporting member is movable to the outside position and the first inside position in the inside of the main assembly; a first positioning portion, provided in the main assembly, for positioning an associated cartridge of the cartridges when the supporting member is located at the first inside position, and a first preventing portion, provided in the main assembly, for preventing rotation of the associated cartridge about the first positioning portion; and a second positioning portion, provided to the supporting member, for positioning the associated cartridge when the supporting member is located between the outside position and the second inside position, wherein the second positioning portion is in a state in which the second positioning portion is spaced from the associated cartridge, when the supporting member is located at the first inside position.

According to another aspect of the present invention, there is provided a cartridge detachably mountable to an image forming apparatus for forming an image on a recording material, wherein the image forming apparatus comprises: a supporting member for supporting a plurality of cartridges, wherein said supporting member is movable to an outside position to which said supporting member is capable of being pulled out of a main assembly of said image forming apparatus and where the cartridges are detachably mountable to the supporting member, a first inside position where the cartridges are positioned to the main assembly in an inside of the main assembly, and a second inside position where the supporting member is movable to the outside position and the first inside position in the inside of the main assembly; a first positioning portion, provided in the main assembly, for positioning an associated cartridge of the cartridges when the supporting member is located at the first inside position, and a first preventing portion, provided in the main assembly, for preventing rotation of the associated cartridge about the first positioning portion; and a second positioning portion, provided to the supporting member, for positioning the associated cartridge when the supporting member is located between the outside position and the second inside position, the cartridge comprising: a first portion-to-be-positioned for engaging with the first positioning portion; a first portion-to-be-prevented for engaging with the first preventing portion; and a second portion-to-be-positioned for engaging with the second positioning portion, wherein the second positioning portion is in a state in which the second positioning portion is spaced from the associated cartridge, when the supporting member is located at the first inside position.

These and other objects, features and advantages of the present invention will become more apparent upon a consideration of the following description of the preferred embodiments of the present invention taken in conjunction with the accompanying drawings.

Figure 5:
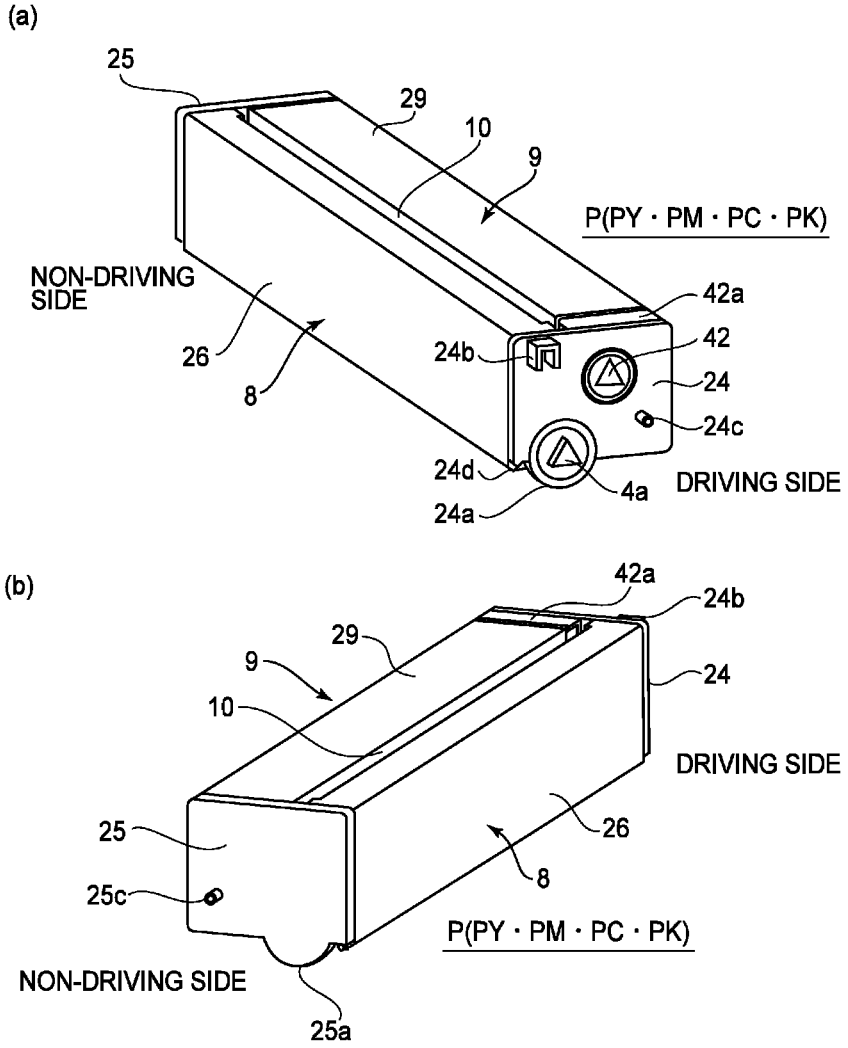

Part (a) of FIG. 5 is a perspective view of the cartridge as seen from the driving side, and (b) of FIG. 5 is a perspective view of the cartridge as seen from the non-driving side.

Figure 6:
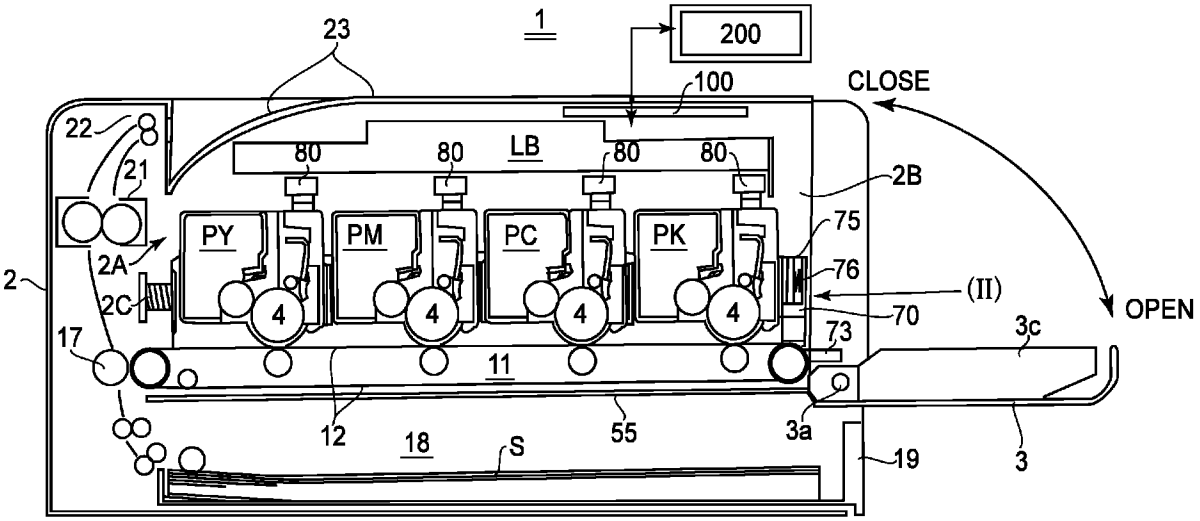

FIG. 6 is a schematic view showing a state in which the front door is opened and the tray is moved upward from a first inside position (I) to a second inside position (II).

Figure 7:
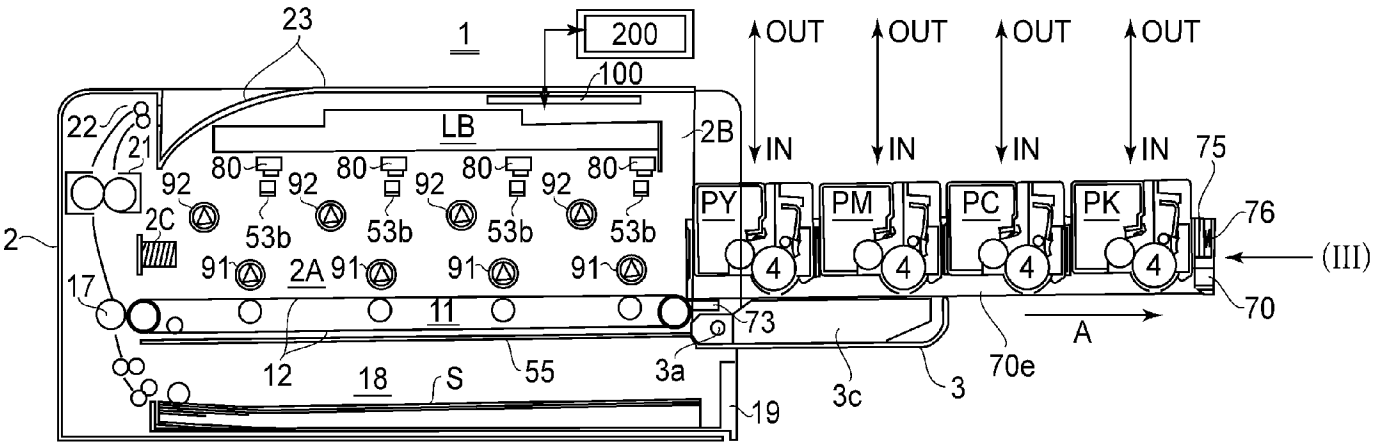

FIG. 7 is a schematic view showing a state in which the tray is pulled out from the second inside position (II) to an outside position (III) outside of the apparatus main assembly.

Figure 8:
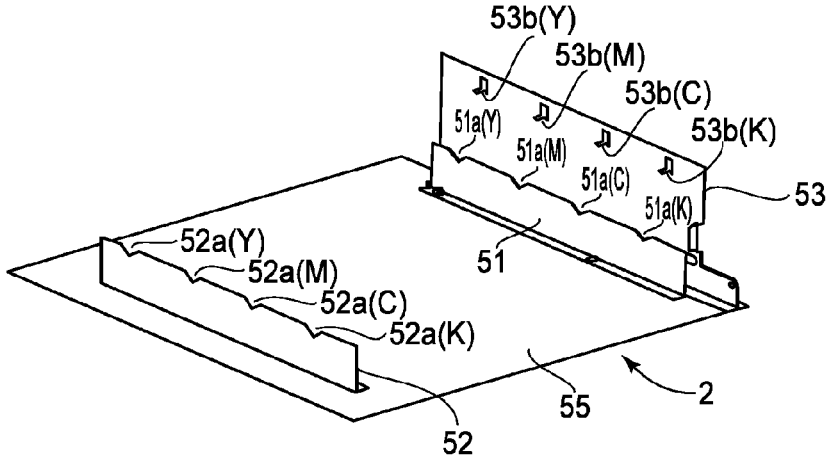
Figure 8:
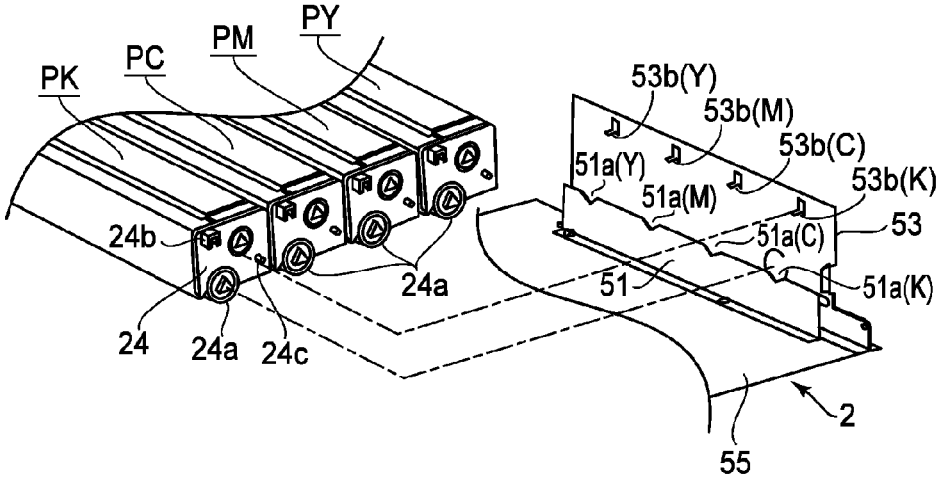

Parts (a) of FIG. 8 is a perspective view showing positioning portions of the apparatus main assembly, and (b) of FIG. 8 is a perspective view showing the positioning portions of the apparatus main assembly and portions-to-be-positioned of cartridges.

Figure 9:
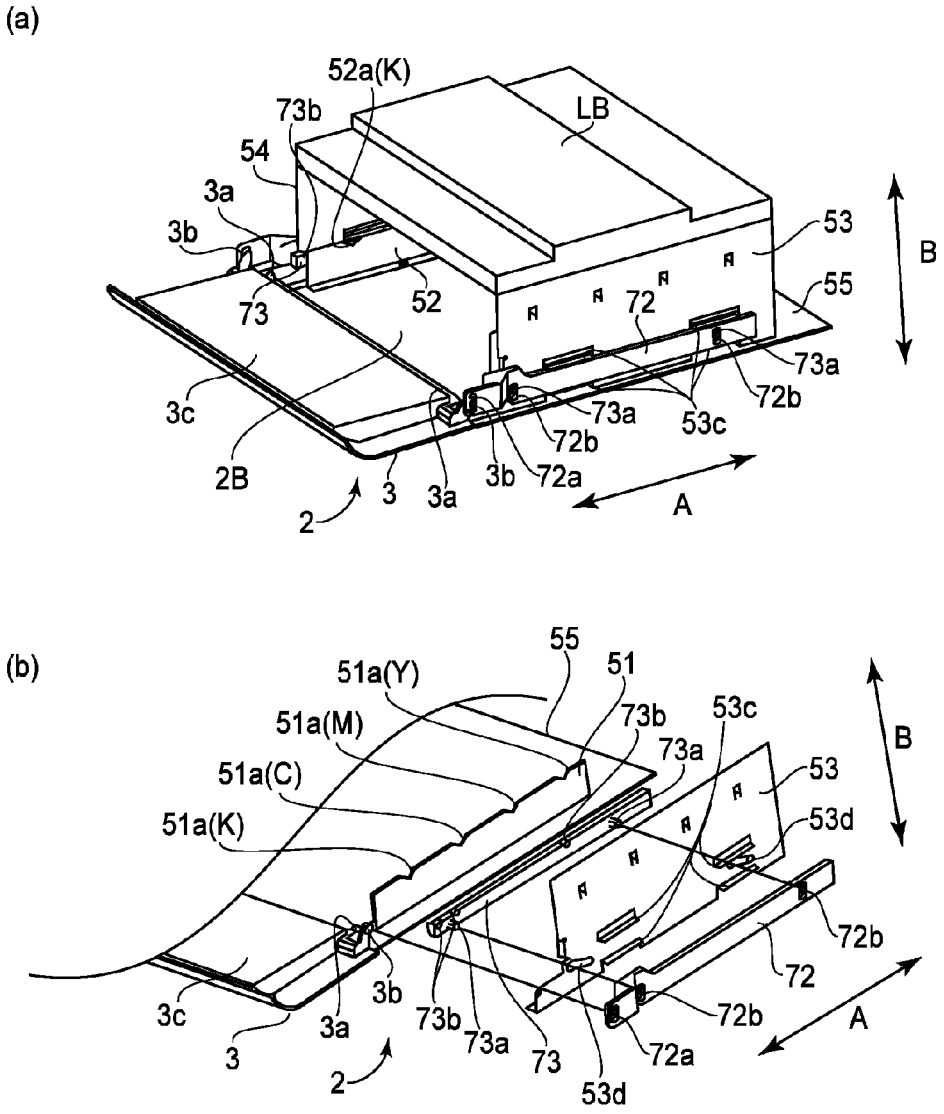
Figure 10A:
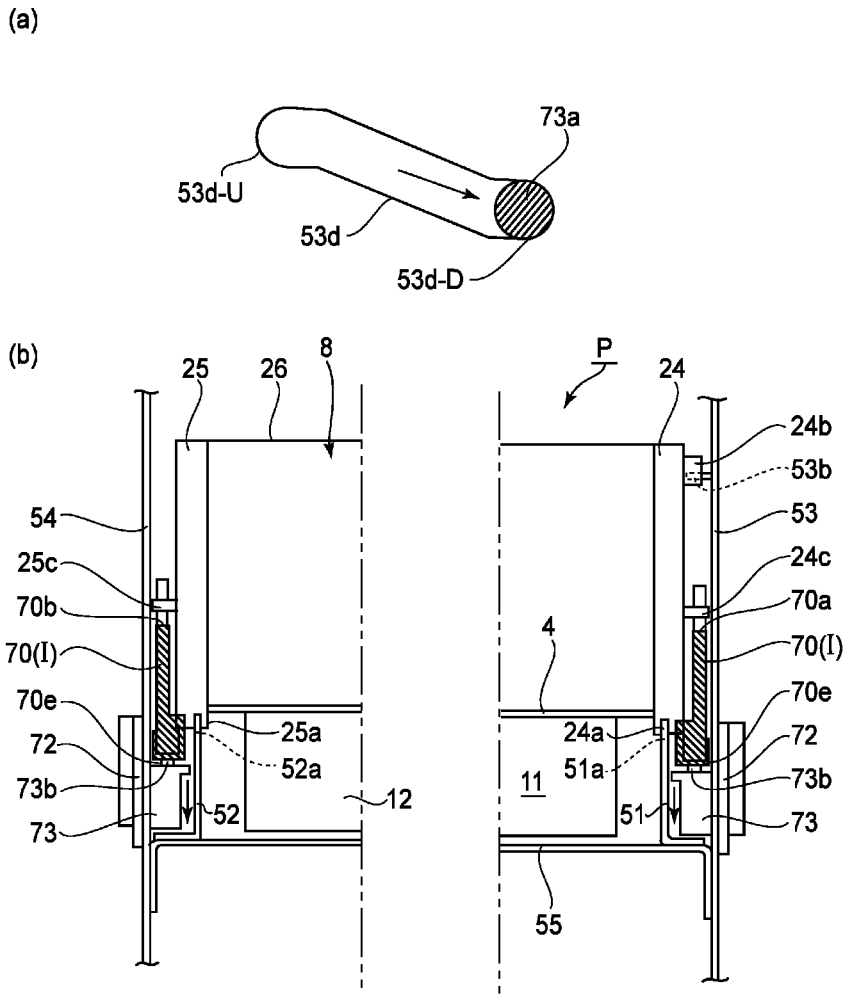
Figure 10B:
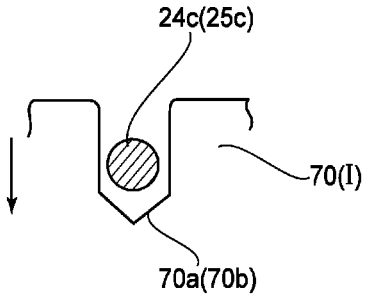
Figure 10B:
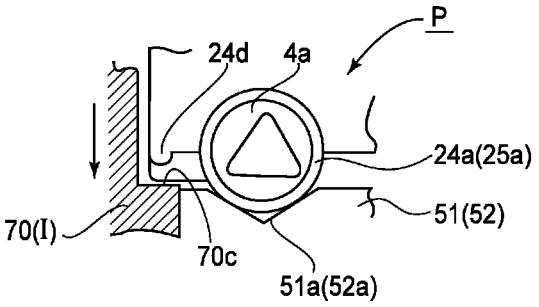
Figure 11A:
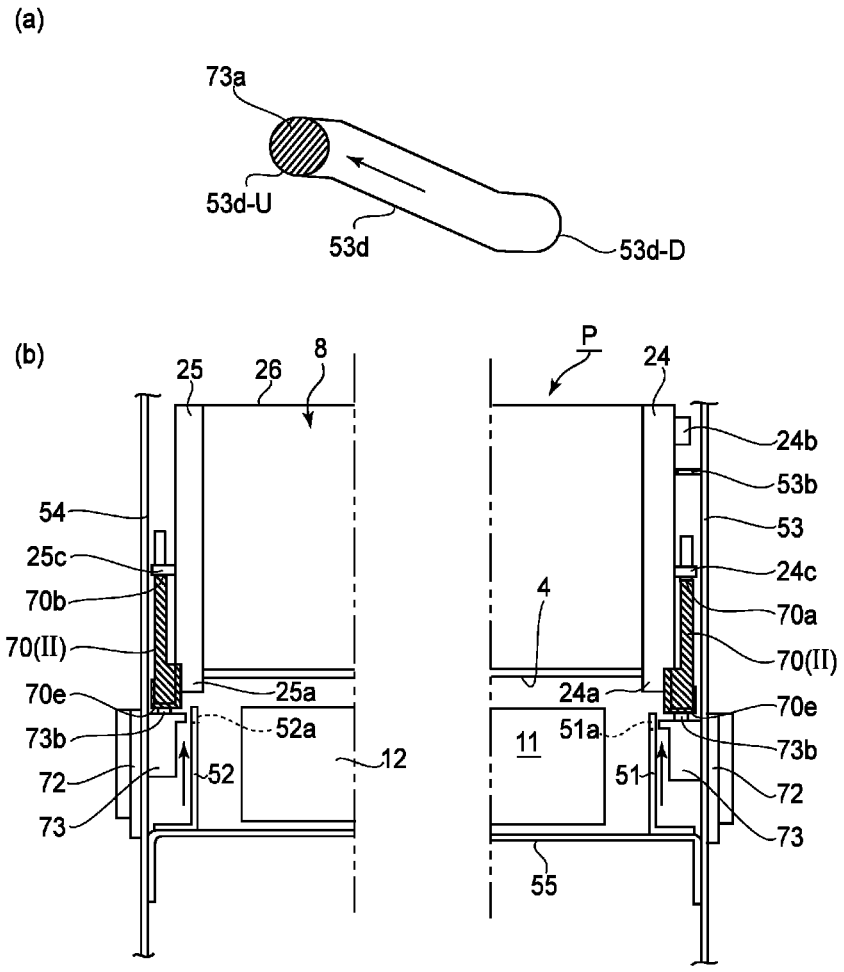
Figure 11B:
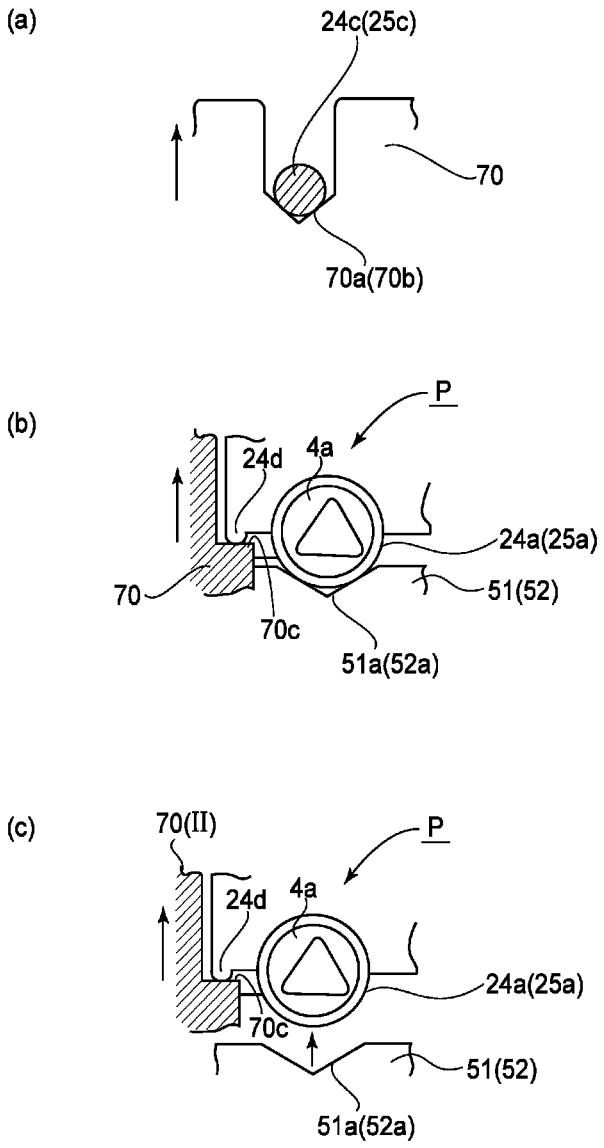

Parts (a) and (b) of FIG. 9, (a) and (b) of FIG. 10A, (a) and (b) of FIG. 10B, (a) and (b) of FIG. 11A, and (a) to (c) of FIG. 11B are schematic views for illustrating a shift mechanism of the tray relative to the apparatus main assembly.

Figure 12:
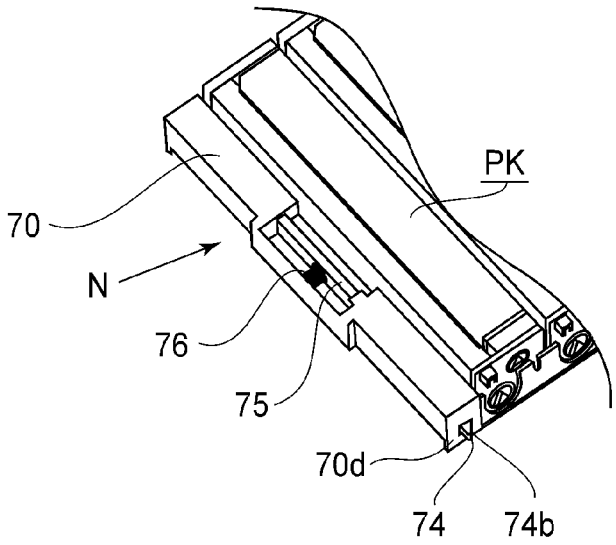
Figure 12:
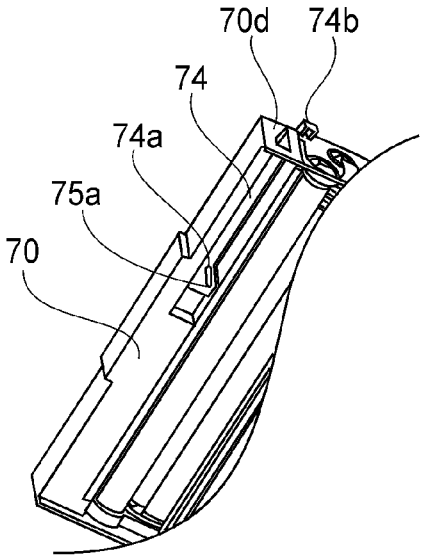
Figure 13:
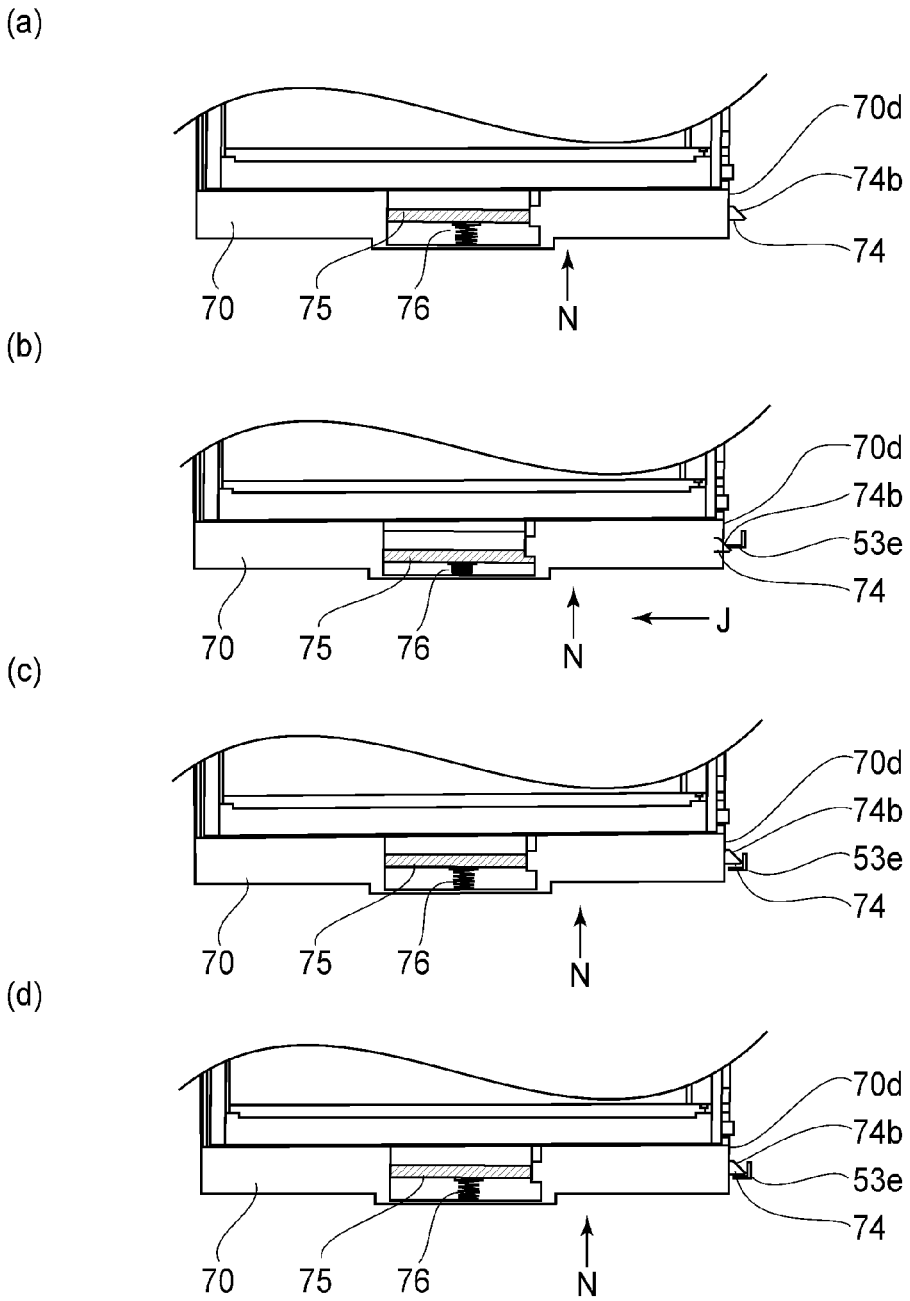

Parts (a) and (b) of FIG. 12 and (a) to (d) of FIG. 13 are schematic views for illustrating a locking portion of the tray with respect to the apparatus main assembly.

Figure 14:
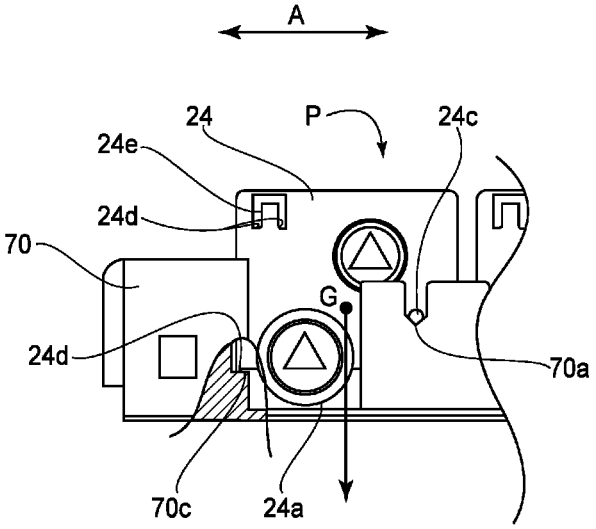
Figure 15:
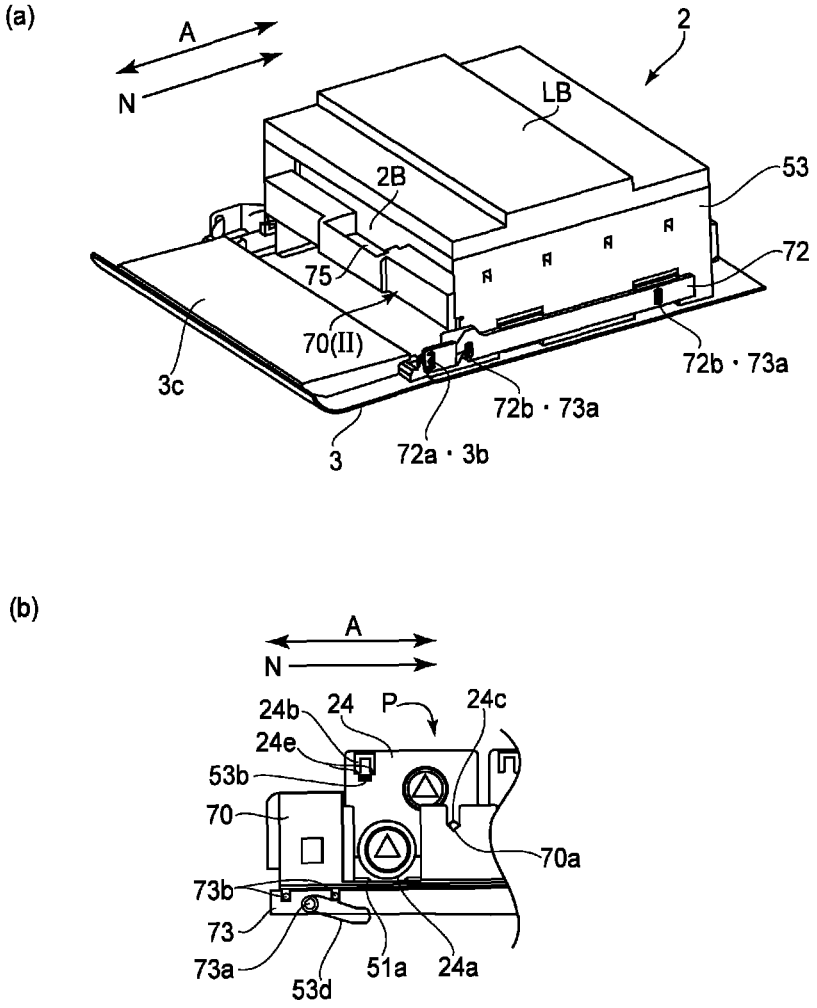
Figure 16:
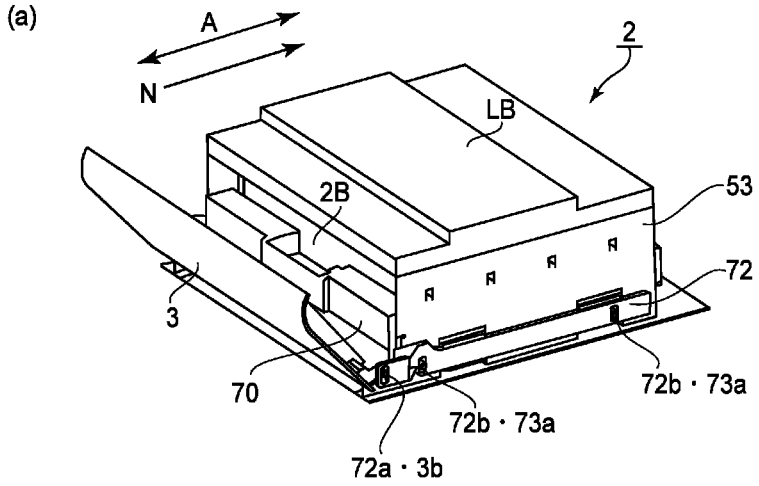
Figure 16:
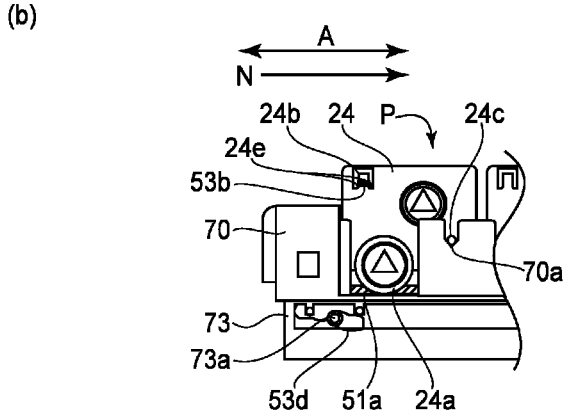

FIG. 14, (a) and (b) of FIG. 15, and (a) and (b) of FIG. 16 are schematic views for illustrating positioning portions of the tray and the portions-to-be-positioned of the cartridges.

Figure 17:
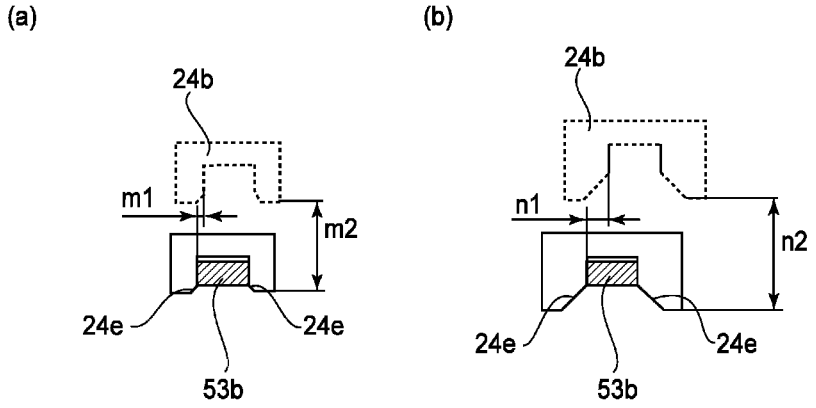

Parts (a) and (b) of FIG. 17 are schematic views for illustrating engagement between a reversed U-shaped groove member and a rotation preventing portion.

Figure 18:
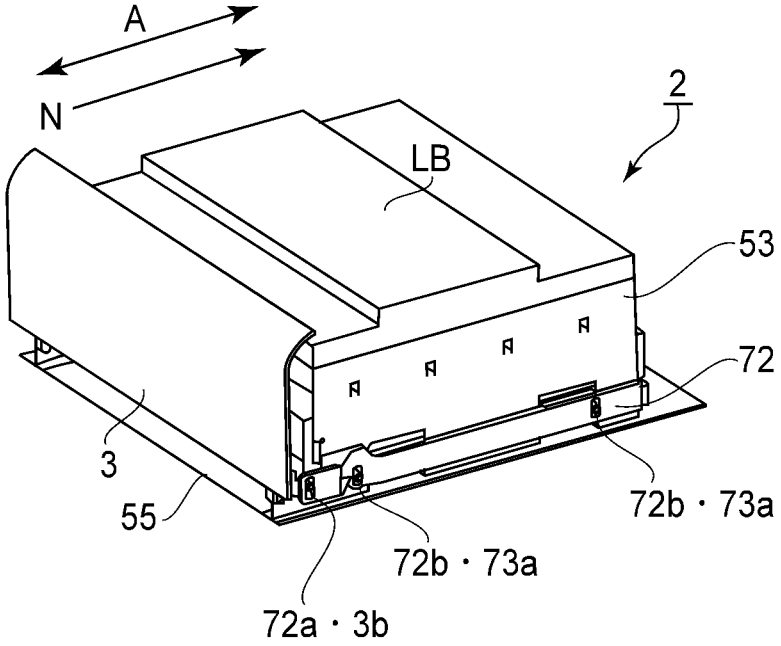
Figure 18:
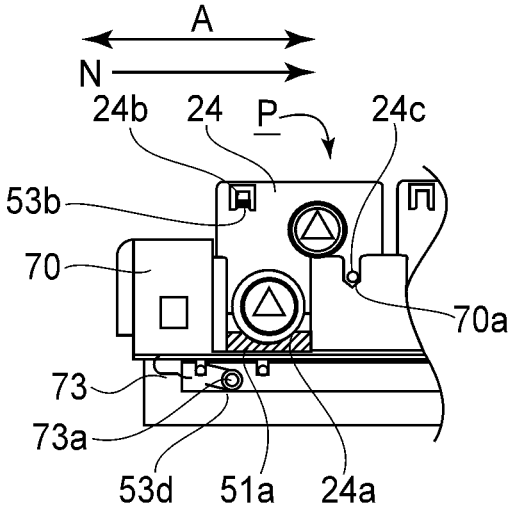

Parts (a) and (b) of FIG. 18 are schematic views for illustrating the positioning portions of the apparatus main assembly and the portions-to-be-positioned of the cartridge.

Figure 19:
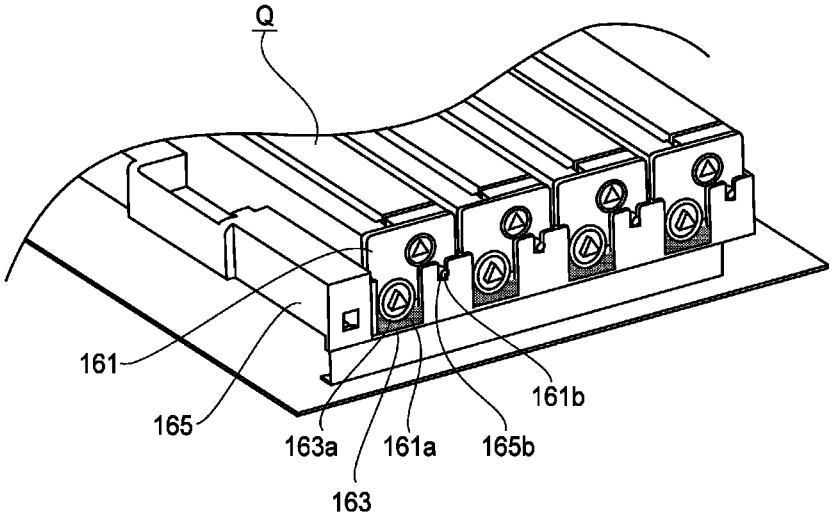

FIG. 19 is a perspective view showing a conventional cartridge positioning method.

DESCRIPTION OF THE PREFERRED EMBODIMENTS

Embodiment 1

General Structure of Image Forming Apparatus

Figure 2:
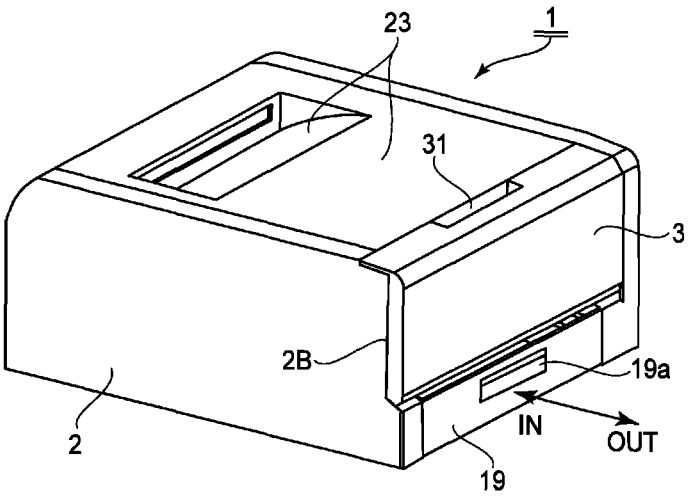
FIG. 2 is a perspective view of an outer appearance of the image forming apparatus.
Figure 3:
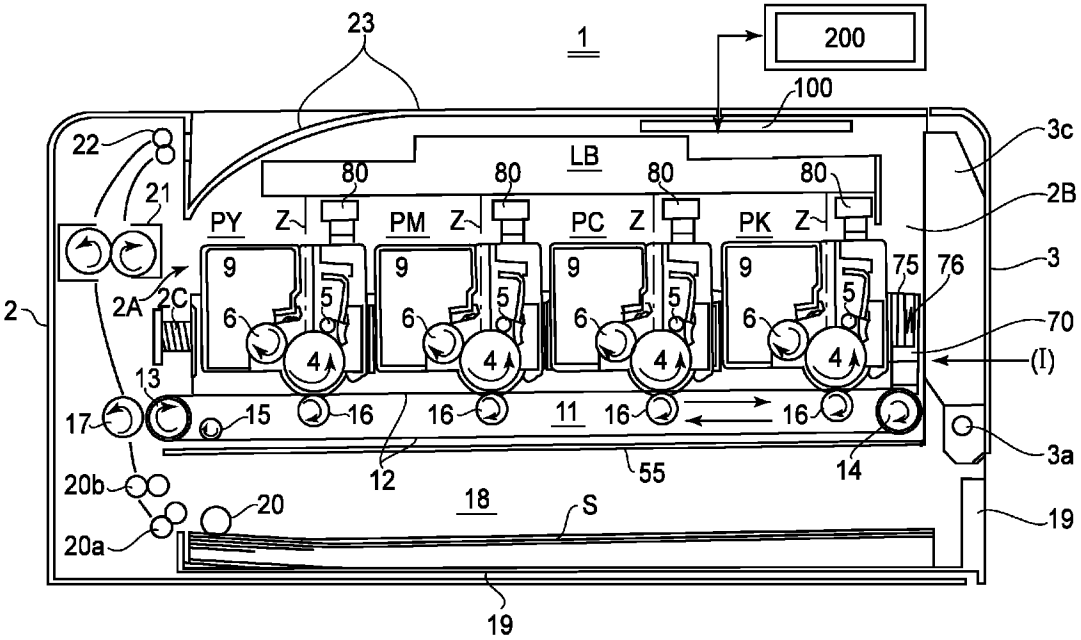
FIG. 3 is a schematic view showing a longitudinal left side surface of the image forming apparatus.

FIG. 2 is a perspective view of an outer appearance of an image forming apparatus 1 in this embodiment, and FIG. 3 is a longitudinal left side surface view of the image forming apparatus 1. The image forming apparatus 1 is a four-color based full-color electrophotographic laser printers, using an electrophotographic process, in which four (first to fourth) process cartridges P (PY, PM, PC, PK) as a plurality of cartridges are provided. The image forming apparatus 1 (printer) can form a four color-based full-color image or a monochromatic image on a sheet-like recording material on the basis of an electrical image signal inputted from an external host device 200 such as a personal computer or an image reader into a control circuit portion (control circuit board) 100.

In the following description, a front side (front surface side) of the image forming apparatus 1 means the side in which an apparatus opening/closing door (front door) 3 is provided. A rear side (rear surface side) of the apparatus 1 is the side opposite to the front side. A frontward direction refers to a direction directed from the rear side toward the front side and a rearward direction refers to a direction opposite to the frontward direction. The left and right (sides) mean the left and right sides when the apparatus 1 is seen from the front side. A leftward direction refers to a direction directed from the right toward left and a rightward direction refers to a direction directed from the left toward the right.

Upward and downward refer to upward and downward in the direction of gravitation, and an upward direction is a direction directed from below toward above and a downward direction is a direction directed from above toward below.

Further, a longitudinal direction is a direction parallel to a rotational axis direction of an electrophotographic photosensitive drum 4 as an image bearing member. A widthwise direction is a direction perpendicular to the longitudinal direction. Further, one end side with respect to the longitudinal is a driving side, and another end side is a non-driving side. In this embodiment, a right end side is the driving side, and a left end side is the non-driving side.

A cartridge accommodating portion 2A is provided inside an apparatus main assembly 2A. In this cartridge accommodating portion 2A, the four (first to fourth) (process) cartridges PY, PM, PC and PK are horizontally arranged from the rear side toward the front side of the apparatus main assembly 2 (inline structure or tandem type).

Figure 4:
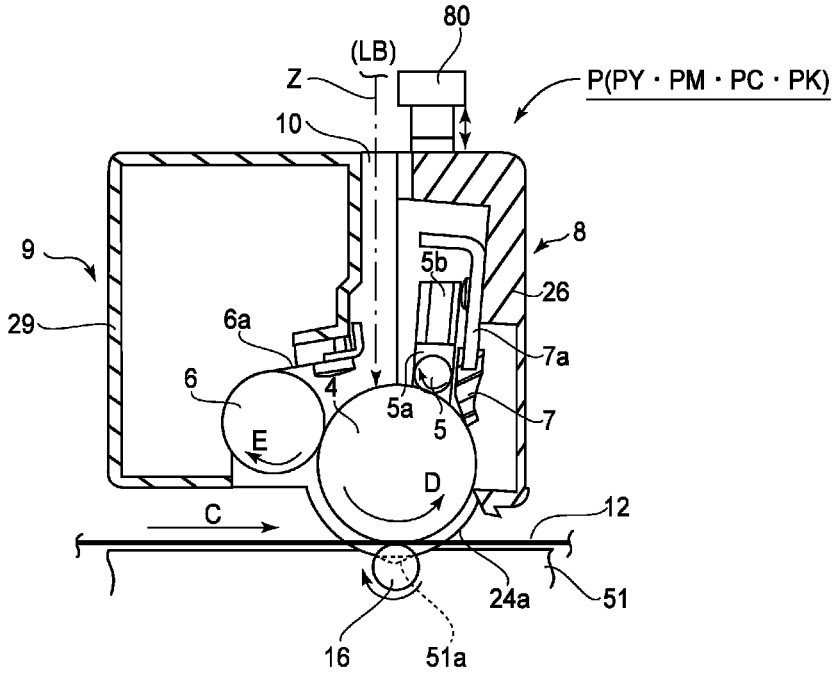
FIG. 4 is an enlarged view of one cartridge portion shown in FIG. 3.

FIG. 4 is an enlarged view of one cartridge portion shown in FIG. 3. In this embodiment, each cartridge P is an integral type process cartridge including the electrophotographic photosensitive drum 4 as the image bearing member and including, as process means acting on the drum 4, a charging means, a developing means and a cleaning means.

In this embodiment, a charging roller 5 is used as the charging means, a developing roller 6 is used as the developing means, and a cleaning blade 7 is used as the cleaning means. The respective cartridges P have the same electrophotographic process mechanism and are different in color of developers (toners). A specific constitution of the cartridge P will be described later.

The first cartridge PY accommodates the toner of yellow (Y) in a developing device 9, and a toner image of yellow (Y) is formed on the surface of the drum 4. The second cartridge PM accommodates the toner of magenta (M) in a developing device 9, and a toner image of magenta (M) is formed on the surface of the drum 4. The third cartridge PC accommodates the toner of cyan (C) in a developing device 9, and a toner image of cyan (C) is formed on the surface of the drum 4. The fourth cartridge PK accommodates the toner of black (K) in a developing device 9, and a toner image of black (K) is formed on the surface of the drum 4.

Each of the cartridges P accommodated in the cartridge accommodating portion 2A is urged from above by an urging (pressing) mechanism 80 in a state in which the door 3 is closed with respect to the apparatus main assembly 2. As a result, each cartridge P is positionally fixed and held by being urged against a portion-to-be-positioned, described later, in the apparatus main assembly 2 side.

In the state, a driving force for rotating the drum 4 from the apparatus main assembly 2 side of the cartridge P can be transmitted, so that the drum 4 is rotationally driven in the counterclockwise direction indicated by an arrow D at a predetermined peripheral speed. Further, a driving force for rotating the developing roller 6 from the apparatus main assembly 2 side to the cartridge P can be transmitted, so that the developing roller 6 is rotationally driven in the clockwise by an arrow E at a predetermined peripheral speed. Further, from the apparatus main assembly 2 side to the cartridge P, predetermined bias voltages (charging bias, developing bias and the like) can be applied toward the charging roller 5 and the developing roller 6.

Above the first to fourth cartridges PY, PM, PC and PK, a laser scanner unit LB as an exposure means is provided. This scanner unit LB outputs laser light Z modulated corresponding to image (picture) information subjected to image processing by the control circuit portion 100. The laser light Z passes through an exposure window portion 10 in an upper surface side of the cartridge P, thus subjecting the surface of the drum 1 to scanning exposure.

An intermediary transfer belt unit 12 as a transfer member is provided below the cartridges PY, PM, PC and PK. The belt unit 12 includes a driving roller 13, a turn roller 14 and a tension roller 15 around which a flexible transfer belt 12 is extended and stretched. The driving roller 13 and tension roller 15 are provided in the rear side in the apparatus main assembly 2. The turn roller 14 is provided in the front side in the apparatus main assembly 2. A lower surface of the drum 4 of each cartridge P contacts an upper surface of an upper-side belt portion of the belt 12. Inside the belt 12, primary transfer rollers 17 contacting the upper-side belt portion of the belt 12 contacted to the lower surface of the drum 4 of the respective cartridges P are provided. In each cartridge P, a contact portion between the drum 4 and the belt 12 is a primary transfer portion. A secondary transfer roller 17 contacts the belt 12 and opposes the driving roller 13 through the belt 12. A contact portion between the belt 12 and the secondary transfer roller 17 is a secondary transfer portion.

Below the unit 11, a (sheet) feeding unit 18 is provided. The unit 18 includes a sheet feeding tray 19 in which sheets of a recording material S are stacked and accommodated, a sheet feeding roller 20, a retard roller pair 20*a* and a registration roller pair 20*b*. The tray 19 is detachably mountable to the apparatus main assembly 2 from the front side of the apparatus main assembly 2 (front loading). A handle (holding) portion 19*a* is provided on a front surface plate of the tray 19. Further, in the rear side of the apparatus main assembly 2, a fixing unit 21 and a (sheet) discharging unit 22 are provided. Further, an upper surface of the apparatus main assembly 2 constitutes a (sheet) discharging tray 23.

(Image Forming Operation)

An operation for forming a full-color image is as follows. The drum 4 of each cartridge P is rotationally driven at a predetermined control speed (arrow D of FIG. 4). Further, also the belt 12 is rotationally driven in the same direction (arrow C of FIG. 4) as the rotational direction of the drum 4 at a speed which corresponds to the speed of the drum 4. The unit LB is also driven.

In this embodiment, the charging roller 5 as the charging means is an electroconductive roller as a contact charging member contacted to the drum 4 with a predetermined urging force and is rotated by the rotation of the drum 4. In synchronization with the drive of the unit LB, a predetermined charging bias is applied to the charging roller 2 in each cartridge. As a result, the surface of the drum 4 is uniformly electrically charged to predetermined polarity and potential.

The unit LB scans (exposes) the surface of each drum 4 with the laser light Z modulated correspondingly to the image signal for an associated color. As a result, an electrostatic latent image corresponding to the image signal for the associated color is formed on the surface of the drum 4. The thus formed electrostatic latent image is developed into a toner image by the developing roller 6 rotationally driven (arrow E of FIG. 4) at the predetermined speed in the developing device (unit) 9. To the developing roller 6, a predetermined developing bias is applied.

Through such an electrophotographic image forming process operation, a yellow (Y) toner image, which corresponds to the yellow (Y) component image of a full-color image is formed on the drum 4 of the first cartridge PY. The toner image is primary-transferred onto the belt 12 at the primary transfer portion of the cartridge PY. To the transfer roller 16, a predetermined primary transfer bias is applied. Similarly, on the drum 4 of the second cartridge PM, a magenta (M) toner image, which corresponds to the magenta (M) component image of the full-color image is formed. The toner image is primary-transferred superposedly onto the Y toner image, which has already been transferred on the belt 12, at the primary transfer portion of the cartridge PM.

Similarly, on the drum 4 of the third cartridge PC, a cyan (C) toner image, which corresponds to the cyan (C) component image of the full-color image, is formed. The toner image is primary-transferred superposedly onto the Y and M toner images, which have already been transferred on the belt 12, at the primary transfer portion of the cartridge PC.

Similarly, on the drum 4 of the fourth cartridge PK, a black (K) toner image, which corresponds to the black (K) component image of the full-color image is formed. The toner image is primary-transferred superposedly onto the Y, M and C developer images, which have already been transferred on the belt 12, at the transfer portion of the cartridge PK.

Thus, an unfixed full-color toner image based on the four colors of Y, M, C and K is formed on the belt 12 passing through the primary transfer portion of the fourth cartridge PK. In each cartridge P, a primary transfer residual toner remaining on the surface of the drum 4 after the primary transfer of the toner images from the drum 4 onto the belt 12 is removed from the drum surface by the cleaning blade 7.

Meanwhile, the feeding roller 20 of the feeding unit 18 is driven with predetermined control timing. As a result, sheets of the recording material S in the tray 19 are fed and then are separated and fed one by one by the retard roller pair 20*a*. The recording material S is introduced into the secondary transfer portion by the registration roller pair 20*b* with predetermined control timing and then is nip-conveyed. During nip-conveyance of the recording material S at the secondary transfer portion, to the secondary transfer roller 17, a predetermined secondary transfer bias is applied. As a result, onto the recording material S, the superposed four color toner images are collectively transferred from the belt 12.

The recording material S coming out of the secondary transfer portion is separated from the surface of the belt 12 and is then guided into the fixing unit 21 to be subjected to heat and pressure in a fixing nip. As a result, the superposed four color toner images are melted and color-mixed, thus being fixed as a full-color fixation image. Then, the recording material S is moved out of the fixing unit 21, and then is discharged as a full-color image formation product onto the discharge tray 25 by the discharge unit 22. In this embodiment, a secondary transfer residual toner remaining on the surface of the belt 12 after the separation of the recording material S is, at the primary transfer portion of the first process cartridge PY, transferred back onto the surface of the drum 4 and then is removed from the surface of the belt 12. Then, the surface of the drum 4 is cleaned by the cleaning blade 7, so that the secondary transfer residual toner is removed from the drum surface together with the primary transfer residual roller.

(Constitution of Cartridge P)

With reference to FIG. 4 and (a) and (b) of FIG. 5, a constitution of the cartridge P (PY, PM, PC, PK) in this embodiment will be described. Part (a) of FIG. 5 is a perspective view of an outer appearance of the cartridge P as seen from a driving side (right end side), and (b) of FIG. 5 is a perspective view of the outer appearance of the cartridge P as seen from a non-driving side (left end side).

The cartridge P is roughly divided into a photosensitive drum unit 8 and a developing unit 9 as a developing device. The drum unit 8 includes the drum 4, the charging roller 5 a cleaning container 26 as a cleaning device frame, and the cleaning blade 7. The cleaning container 26 is integrally provided with a driving side cover member (right and plate) 24 in one end side and a non-driving side cover member (left side plate) 25 with respect to its longitudinal direction.

The drum 4 is rotatably supported between the cover members 24 and 25 by driving side and non-driving side bearing members (not shown) provided at lower portions of the cover members 24 and 25, respectively. The charging roller 5 is rotatably supported by movable bearing members 5*a* at its end portions and is pressed against the drum 4 with a predetermined pressure by an urging force of an urging member for urging the bearing members 5*a* toward the drum 4. The charging roller 5 is rotated by the rotation of the drum 4.

The cleaning blade 7 is an elastic rubber blade elongated in the longitudinal direction of the drum 4. This blade 7 is held by a supporting metal plate 7*a* and is fixedly provided on the cleaning container 26 via the supporting metal plate 7*a* in a state in which its (free) end portion is contacted to the drum 4 with a predetermined pressure with respect to a counter direction to a rotational direction of the drum 4. The primary transfer residual toner remaining on the surface of the drum 4 is scraped off by the blade 7 and is collected in the cleaning container 26.

The developing unit 9 includes a developing container 29 as a developing device frame, the developing roller 6 as a developer carrying member for supplying the toner to the drum 4 to develop the electrostatic latent image on the drum 4, and a developer regulating member (developing blade) 6*a*. The developing roller 6 is rotatably supported by the developing container 29 or bearing members (not shown) by driving side and nondriving side shafts provided at longitudinal end portions of the developing container 29. The developer regulating member 6*a* is contacted to the developing roller at its (free) end portion and performs the function of regulating the toner in a thin layer on the peripheral surface of the developing roller 6.

The developing unit 9 is provided swingably about a predetermined swing shaft portion (not shown) between the cover members 24 and 25. The developing unit 9 is swung and urged about a swing shaft portion by an urging member (not shown) so that the developing roller 6 is contacted to the drum with predetermined pressure (contact development). In the case of non-contact development, the developing unit 9 is swung and urged about the swing shaft portion by the urging member so that spacer rollers provided at end portions of the developing roller 6 are contacted the drum 4 in end sides with predetermined pressure and thus the developing roller 6 opposes the drum 4 in a non-contact with a predetermined gap.

A gap is formed between the cleaning container 26 and the developing container 29. At this gap portion, an opening in a cartridge upper surface side is an exposure window portion 10, and the laser light Z from the unit LB enters the gap portion through this window portion 10 to reach the surface of the drum 4.

In an outer surface side of the driving side cover member 24, a drum driving coupling 4*a* as a drive input portion of the drum 4 is provided. The coupling 5*a* is provided coaxially with a rotation center axis of the drum 4. Similarly, in the outer surface side of the cover member 24, a developing roller driving coupling 42 as a drive input portion of the developing roller 6 is provided.

In a state in which the cartridge P is mounted and positionally fixed at the cartridge accommodating portion 2A in the apparatus main assembly 2, to the cartridge 4*a* and the cartridge 42, couplings 91 and 92 (FIG. 7) as a drive output portion in the apparatus main assembly side are connected, respectively, a developing force is inputted from the coupling 91 into the cartridge 4*a*, so that the drum 4 is rotationally driven at a predetermined speed in a predetermined direction D. Further, by the input of the driving force from the coupling 92 into the cartridge 42, the driving force is transmitted to the developing roller 6 via a gear train (not shown) in a gear box 42*a*, so that the develop 6 is rotationally driven at a predetermined speed in a predetermined direction E.

Further, in a state in which the cartridge P is mounted and positionally fixed in a predetermined manner at the cartridge accommodating portion 2A in the apparatus main assembly 2, electric contacts (not shown) in the cartridge P side and electric contacts (not shown) in the apparatus main assembly 2 side are electrically conducted to each other. As a result, it is possible to apply bias voltages (charging bias, developing bias and the like) from the apparatus main assembly 2 to the charging roller 5 and the developing roller 6 in the cartridge P.

The cartridge P includes arcuate portions 24*a* and 25*a*, as a first portion-to-be-positioned, provided to the driving side and non-driving side cover members 24 and 25, respectively. The arcuate portions 24*a* and 25*a* are provided downward at lower edges of the cover members 24 and 25, respectively, and are coaxial with the rotation center axis of the drum 4 and have a diameter somewhat larger than that of the drum 4. Further, the cartridge P includes a reversed U-shaped groove member 24*b* as a first portion-to-be-prevented on the outer surface of the driving side cover member 24.

Further, the cartridge P includes bosses 24*c* and 25*c*, as a second portion-to-be-positioned, provided on the outer surfaces of the driving side and non-driving side cover members 24 and 25, respectively. Further, the cartridge P includes a downward projection 24*d*, as a second portion-to-be-prevented, at a lower edge (end) portion of the driving side cover member 24.

(Cartridge Exchange Method)

As each of the first to fourth cartridges PY, PM, PC and PK is used for image formation, the developer stored in the developing unit 9 is consumed. For this reason, e.g., the cartridge P is provided with a detecting means (not shown) for detecting an amount of the developer remaining in each cartridge. A value of the remaining amount detected by the detecting means is compared, by the control circuit portion 100, with a threshold (value) preset for providing a pre-warning or warning of the lifetime of the cartridge. When the remaining amount value of the developer in the cartridge is decreased to a value smaller than the threshold, the pre-warning or warning of the lifetime of the cartridge is displayed on a display portion (not shown) in the apparatus main assembly 2 side or the host device 200 side. As a result, the image forming apparatus prompts the user to prepare a cartridge for exchange or to replace (exchange) the cartridge to maintain an output image quality.

The apparatus 1 in this embodiment employ, in order to improve usability, an exchanging method in which the cartridge P is placed on a supporting member 70 movable member for moving while supporting the cartridge P: cartridge tray) and is replaced in a front access manner.

In the front side of the apparatus main assembly 2, an opening (main assembly opening) 2B for permitting passing of the cartridges P together with the tray 70 therethrough is provided in order to insert the cartridges P into the apparatus main assembly 2 and demount the cartridges P from the apparatus main assembly 2. The front door 3 as an openable member movable between a closed position in which the opening 2B is covered (closed) and an open position in which the opening 2B is exposed (opened).

In this embodiment, the door 3 can be opened and closed and can be rotationally moved relative to the apparatus main assembly 2 about a rotation center boss 3*a* in a door lower edge side. As shown in FIGS. 2 and 3, the door 3 is erected and rotated about the boss 3*a* to be closed with respect to the apparatus main assembly 2, so that the opening 2B is closed (covered). Further, the door 3 is rotated forward about the boss 3*a* in the substantially horizontal direction, so that as shown in FIG. 6, the door 3 is opened with respect to the apparatus main assembly 2 and thus the opening 2B is considerably exposed. To the door 3, a handle (holding) portion 31 is provided.

Figure 1A:
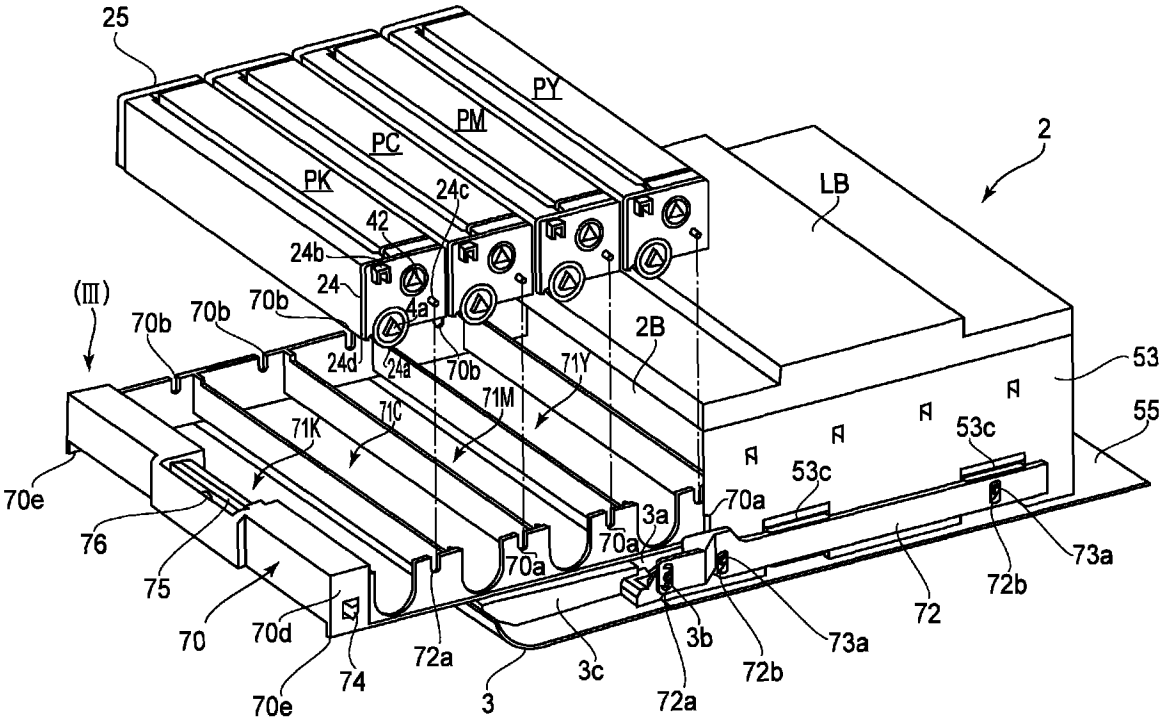
FIG. 1A is a perspective view of an image forming apparatus in an embodiment, as seen from a driving side, in which a state in which a front door is opened and a tray (supporting member) is pulled out to an outside of an apparatus main assembly through an opening of the apparatus main assembly.
Figure 1B:
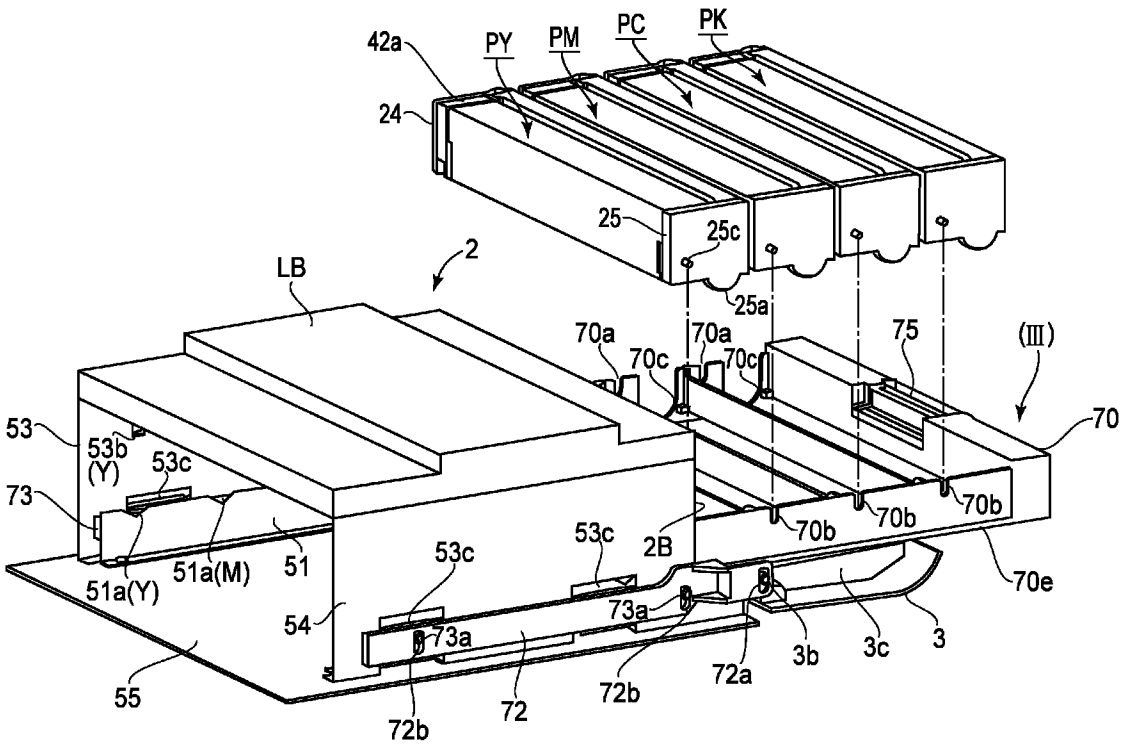
FIG. 1B is a perspective view of the image forming apparatus as seen from a non-driving side.

A constitution of the tray 70 will be described with reference to FIGS. 1A and 1B, FIG. 1A is a perspective view of the tray 70, as seen from the driving side, showing a state in which the door 3 is opened and the tray 70 is pulled out from the inside to the outside of the apparatus main assembly 2 through the opening 2B of the apparatus main assembly 2. FIG. 1B is a perspective view of the tray 70 as seen from the non-driving side. Incidentally, the apparatus main assembly 2 is illustrated in a state of a metal plate frame constituting a framework of the apparatus main assembly by omitting its outer casing. Further, the metal plate at portions where the feeding unit 18, the fixing unit 21 and the discharging unit 22 are provided is omitted.

The tray 70 is an open frame, at upper and lower surfaces, including a rectangular (large) frame portion. An inner portion of the frame is divided (partitioned) into 4 substantially equal parts by partition plates with respect to a front-rear direction, so that first to fourth (four) elongated small-frame portions 71 (71Y, 71M, 71C, 71K) are provided and arranged in the order from a rear side to a front side. The small-frame portions 71Y, 71M, 71C and 71K are portions for supporting the first to four cartridges PY, PM, PC and PK, respectively, by inserting the cartridges from above. Each small-frame portion 71 is provided with an opening at its side surface in the driving side.

At upper edge portions of each small-frame portion 71 in the driving side and the non-driving side, as a second positioning portion, V(U)-character portions 70*a* and 70*b* which are open upward are formed, respectively. The bosses 24*c* and 25*c* as the second portion-to-be-positioned in the cartridge P side correspond to the V-character portions 70*a* and 70*b*, respectively. Further, each small-frame portion 71 is provided with a preventing surface 70*c* as a second preventing portion at its inner lower portion in the driving side. The projection 24*d* as the second portion-to-be-prevented in the cartridge P side corresponds to the preventing surface 70*c*.

The tray 70 is pulled out from the inside to the outside of the apparatus main assembly 2 in a state in which the door 3 is opened and thus the opening 2B is exposed, so that it can take, as shown in FIGS. 1A, 1B and 7, an outside position (III) where each cartridge P is detachably mountable. Further, the tray 71 can take, in a state the door 3 is closed, a first inside position (I) where each cartridge P is positioned to the apparatus main assembly 2 in the inside of the apparatus main assembly 2 as shown in FIG. 3.

Further, the tray 71 can take, in the state in which the door 3 is opened and thus the opening 2B is exposed, a second inside position (II) as shown in FIG. 6 located inside the apparatus main assembly 2 between the outside position (III) and the first inside position (I). The tray 70 is moved from the first inside position (I) to the second inside position (II) and from the second inside position (II) to the first inside position (I) by a shift(ing) mechanism, described later, operated in interrelation with the opening/closing opening of the door 3. A manner of exchange of the cartridge P with respect to the apparatus main assembly 2 is as follows.

(1) As shown in FIGS. 2 and 3, in a state in which the door 3 is closed with respect to the apparatus main assembly 2 and thus the opening 2B is covered (closed), the tray 70 is held at the first inside position (I) by the shift mechanism. In this state, each cartridge P accommodated in the associated small-frame portion 71 is pressed from above by a pressing mechanism 80 in the drum unit 8 side at the cartridge accommodating portion 2A in the inside of the apparatus main assembly 2. As a result, each cartridge P is pressed against the positioning portions, described later, in the apparatus main assembly 2 side, thus being positionally fixed and held.

Further, to the couplings 4*a* and 42 of each cartridge P positionally fixed in the apparatus main assembly 2 side as described above, the couplings 91 and 92 (FIG. 7) as a drive output portion in the apparatus main assembly 2 side are connected, respectively. Further, an electric contact (not shown) in the cartridge P side and an electric contact (not shown) in the apparatus main assembly 2 side are electrically conducted. Further, a lower surface of the drum 4 of each cartridge P is contacted to the belt 12, so that the primary transfer portion is formed.

(2) In the above state, the apparatus 1 is capable of performing an image forming operation. In this state, a user performs the opening operation of the door 3 as shown in FIG. 6. In interrelation with this opening operation of the door 3, during an initial stage of the opening operation of the door 3, the apparatus main assembly-side couplings 91 and 92 perform a retraction operation from the couplings 4*a* and 42 of each cartridge P, thus releasing the coupling connection. The electric contact in the apparatus main assembly 2 side is retracted from the electric contact in the cartridge P side to eliminate the electric conduction.

Then, the pressing of the drum unit 8 of each cartridge P by the pressing mechanism 80 is eliminated. Although a specific constitution of the pressing mechanism 80 is omitted from illustration, it is possible to employ an appropriate mechanism constitution such as a pressing/pressing-elimination mechanism using an electromagnetic solenoid and plunger or a pressing/pressing-elimination mechanism using a lever and a spring.

(3) By the shift mechanism interrelated with a further opening operation of the door 3, the tray 70 is moved upward from the first inside position (I) of FIG. 3 in the inside of the apparatus main assembly 2. In a state in which the door 3 is sufficiently opened to a predetermined open position as shown in FIG. 6, the tray 70 is located at the second inside position (II) where the tray 70 is raised (moved upward) from the first inside position (I) with a predetermined amount of movement in the inside of the apparatus main assembly 2. The door 2 sufficiently opened to the predetermined open position is stably held at the open position even when a hand is thereafter removed from the door 3. Also the tray 70 is stably held at the second inside position (II).

Driving side and non-driving side lower edge portions 70*e* of the frame portion, extending in the front-rear direction, of the tray 70 are slidably mounted on rails 73. The tray 70 is moved upward and downward by moving the rails upward and downward.

Each cartridge P is raised together with the upward movement of the tray 70 while being supported by the tray 70 from the midstream of the upward movement of the tray 70 from the first inside position (I) to the second inside position (II). As a result, each cartridge P rises from the second portion-to-be-positioned in the apparatus main assembly 2 side and is moved away from the second portion-to-be-positioned and at the same time, the lower surface of the drum 4 is moved away from the upper surface of the belt 12 so as to be placed in a non-contact state.

(4) By sufficiently opening the door 3 to expose the opening 2B, the front frame portion of the tray 70 located at the second inside position (II) is exposed through the opening 2B. The front frame portion is provided with a movable holding (handle) portion 75. The user puts his (her) hand or fingers on the holding portion 75 and moves the holding portion 75 toward the front side against pressure of a holding portion urging spring 76.

As a result, a locking state of a locking portion, described later, which locks the tray 70 in the apparatus main assembly 2 side is eliminated. By this locking (state) elimination, the tray 70 can be moved from the inside to the outside of the apparatus main assembly 2 along the horizontal rails 73, extending in the front-rear direction, of the shift mechanism and further along guide portions 3*c*, with a horizontal upper surface, provided inside of the opened door 3. Each guide portion 3*c* is, in a state in which the door 3 is opened in a predetermined manner, located on an extension line of the main assembly-side rail 73, so that a guide surface is at the same height level as that of a tray guide surface of the rail 73.

(5) The user sufficiently pulls out the tray 70, located at the second inside position (II) of the apparatus main assembly 2 as shown in FIG. 6, to the outside position (III) along the rail 73 shown in FIG. 7 and further about the guide portion 3*c* in the door 3 side. In the state in which the tray is located at the second inside position (II), the lower surface of the drum 4 of each cartridge P is spaced from the upper surface of the belt 12 so as to be placed in the non-contact state. Therefore, in a process in which the tray 70 supporting the cartridges P is moved from the second inside position (II) to the outside position (III), the drum 4 and the belt 12 are prevented from being damaged by being rubbed with each other.

When the tray 70 is sufficiently pulled out to the outside position (III), further pulling-out movement of the tray 70 is prevented by a stopper member (not shown). Further, the tray 70 is held, in the state in which the tray 70 is horizontally pulled out to the outside position (III), by the main assembly-side rails 73 and the guide portions 3*c* in the door 3 side.

As shown in FIG. 7, in the state in which the tray 70 is sufficiently pulled out to the outside position (III), all of the first to fourth (four) cartridges PY, PM, PC and PK pass through the opening 2B to be exposed to the outside of the apparatus main assembly 2. As a result, the upper surfaces of all of the cartridges P are exposed.

The tray 70 roughly supports the individual cartridges P so that the cartridges PY, PM, PC and PK can be demounted from the small-frame portions 71Y, 71M, 71C and 71K, respectively, to right above. Further, the tray 70 supports the individual cartridges P by dropping the cartridges PY, PM, PC and PK in the small-frame portions 71Y, 71M, 71C and 71K, respectively, toward right below. The user demounts the used (spent) cartridge, to be exchanged, from the tray 70 by raising the cartridge. Then, the user engages a new (fresh) cartridge into the tray 70 from above.

As described above, when the tray 70 is pulled out to the predetermined outside position (III) in the outside of the apparatus main assembly 2, all of the cartridges P are moved to the outside of the apparatus main assembly 2. Therefore, the user easily performs an exchanging operation when the cartridge P is exchanged with respect to the tray 70.

(6) After the new cartridge P is replaced with the old cartridge P with respect to the tray 70, the user slidably moves the tray 70, pulled out to the outside position (III), in a reverse order to the above-described order, by passing the tray 70 in the rear direction along the guide portions 3*c* in the door 3 side and further along the main assembly-side rails 73. Then, the user pushes the tray 70 from the opening 2B to the inside of the apparatus main assembly 2. The tray 70 abuts, at its rear frame portion, against a spring (supporting member regulating spring) 2C, provided in the rear side in the apparatus main assembly 2, at a position somewhat in front of a position where the tray 70 reaches the second inside position (II). The tray 70 is further pushed in and moved against elasticity of the spring 2C while being compressed.

Also when the tray 70 is pushed in and moved, the lower surface of the drum 4 of each cartridge P supported by the tray 70 is spaced from the upper surface of the belt 12 so as to be placed in the non-contact state. Therefore, in a process in which the tray 70 is moved from the outside position (III) to the second inside position (II), the drum 4 and the belt 12 are prevented from being damaged by being rubbed with each other.

When the tray 70 reaches the second inside position (II), the tray 70 is prevented from being moved back by being locked with respect to the apparatus main assembly by a locking operation of the locking portion described later, so that as shown in FIG. 6, the tray 70 is returned to the state in which the tray 70 is held at the second inside position (II). In this state, the tray 70 is stably held at the second inside position (II) even when the user removes his (her) hand from the tray 70.

(7) The user performs a closing operation of the opened door 3. By the shift mechanism interrelated with this closing operation of the door 3*d*, the tray 70 is moved downward from the second inside position (II) in the inside of the apparatus main assembly 2. Together with the downward movement of the tray 70, also the first to fourth cartridges PY, PM, PC and PK supported by the tray 70 are moved downward.

When the tray 70 is moved downward from the second inside position (II) with a predetermined amount of movement, the arcuate portions 24*a* and 25*a* at the first portion-to-be-positioned of each cartridge P are received by first positioning portions 51*a* and 52*a* (FIG. 8), described layer, in the apparatus main assembly 2 side. As a result, each cartridge P is prevented from being further moved downward. Further, the reversed U-character groove member 24*b* at the first portion-to-be-prevented of each cartridge P is engaged with a first preventing portion 53*b* (FIG. 8), described later, in the apparatus main assembly side. As a result, each cartridge P is prevented from being rotated. Further, the lower surface of the drum 4 of each cartridge P is placed in a state in which it is contacted to the upper surface of the belt 12.

The tray 70 is further moved downward by the shift move in interrelation with a further closing operation of the door 3, so that the tray 70 reaches the first inside position (I) in a stage somewhat before the door 3 is sufficiently closed, thus being placed in a held state at the first inside position (I).

In the state in which the tray 70 is held at the first inside position (I), the V(U)-character portions 70*a* and 70*b* provided in the tray 70 side corresponding to each cartridge P are spaced from the bosses 24*c* and 25*c* of each cartridge P. Further, the preventing surface 70*c* provided to the tray 70 correspondingly to each cartridge P is spaced from the projection 24*d* of each cartridge P. That is, the support of each cartridge P by the tray 70 is eliminated.

Each cartridge P is, even when the support by the tray 70 is eliminated, still received by the first positioning portions 51*a* and 52*a* in the apparatus main assembly side at its arcuate portions 24*a* and 25*a* as the first portion-to-be-positioned. Further, the reversed (downward) U-character groove member 24*b* as the first portion-to-be-prevented is prevented from being rotated by being engaged with the first preventing portion 53*b* in the apparatus main assembly side. As a result, each cartridge P is stably held in the apparatus main assembly 2 side.

(8) In interrelation with a further closing operation of the door 3, the pressing mechanism 80 corresponding to each cartridge P performs a pressing operation, so that the drum unit 8 of each cartridge P is pressed from above. As a result, the arcuate portions 24*a* and 25*a* of each cartridge P are pressed against the first positioning portions 51*a* and 52*a* in the apparatus main assembly side, each cartridge P is sandwiched between the pressing mechanism 80 and the first positioning portions 51*a* and 52*a*. That is, each cartridge P is positionally fixed and held by the apparatus main assembly 2 at the cartridge accommodating portion 2A inside the apparatus main assembly 2.

Further, in interrelation with the further operation of the door 3, to the couplings 4*a* and 42 of each cartridge P positionally fixed to the apparatus main assembly 2 as described above, the couplings 91 and 92 as the drive output portion in the apparatus main assembly side are connected, respectively. Further, the electric contact in the apparatus main assembly 2 side is electrically conducted to the electric contact in the cartridge P side. Then, the door 3 is sufficiently closed, so that the apparatus 1 is restored to the state of FIGS. 2 and 3 to be placed in a state in which the apparatus 1 can perform the image forming operation. The closed state of the door 3 is stably kept.

(Positioning of Cartridge P in Apparatus Main Assembly)

Part (a) of FIG. 8 shows only parts relating to the positioning of the cartridges P mounted in the apparatus main assembly 2. On a bottom plate 55 of the apparatus main assembly 2, a driving side main assembly side plate 53, a non-driving side main assembly side plate 54 (FIG. 1B), a driving side cartridge holder 51 and a non-driving side cartridge holder 52 are mounted.

Part (b) of FIG. 8 schematically illustrates a positioning state of the cartridges P in the apparatus main assembly 2, in which the non-driving side is not illustrated. In the apparatus main assembly 2, each cartridge P is positioned to the apparatus main assembly 2 by the driving side and non-driving side cover members 24 and 25.

As described with reference to FIG. 5, in the cartridge P side, the driving side and non-driving side cover members 24 and 25 are provided, at their lower edges, with the arcuate portions 24*a* and 25*b*, respectively, provided downward as the first portion-to-be-positioned. The arcuate portions 24*a* and 25*a* are coaxial with the rotation center axis of the drum 4 and are made somewhat larger in diameter than that of the drum 4. Further, each cartridge P includes the reversed U-character groove member 24*b*, as the first portion-to-be-prevented, provided on the outer surface of the driving side cover member 24.

On the other hand, in the apparatus main assembly 2 side, the driving side and non-driving side cartridge holds 51 and 52 are provided with four V-character portions 51*a* and four V-character portions 52*a*, respectively, which are open upward and are used as the first positioning portions corresponding to the arcuate portions 24*a* and 25*a* of each cartridge P.

The V-character portions 51*a*(Y) and 52*a*(Y) are associated with the arcuate portions 24*a* and 25*a* of the cartridge PY. The V-character portions 51*a*(M) and 52*a*(M) are associated with the arcuate portions 24*a* and 25*a* of the cartridge PM. The V-character portions 51*a*(C) and 52*a*(C) are associated with the arcuate portions 24*a* and 25*a* of the cartridge PC. The V-character portions 51*a*(K) and 52*a*(K) are associated with the arcuate portions 24*a* and 25*a* of the cartridge PK.

Further, the driving side main assembly side plate 53 includes four rotation-stopping portions 53*b* as a first preventing portion corresponding to the reversed U-character groove member 24*b* of each cartridge P. Each rotation-stopping portion 53*b* is a tongue piece which is cut and erected inward from the main assembly side plate 53. The rotation-stopping portions 53*b*(Y), 53*b*(M), 53*b*(C) and 53*b*(K) are associated with the cartridges PY, PM, PC and PK, respectively. A groove portion of the member 24*b* in each cartridge P side is engaged with and disengaged from the rotation-stopping portion 53*b*.

The apparatus main assembly 2 is configured to receive the arcuate portions 24*a* and 25*a* of each cartridge P by the V-character portions 51*a* and 52*a* in the apparatus main assembly 2 side. Each cartridge P is supported by the V-character portions 51*a* and 52*a* with the centers of the arcuate portions 24*a* and 25*a* as the rotation center. Further, by using the member 24*b* as a means for determining a rotation phase of each cartridge P, the apparatus main assembly 2 is configured to determine the rotation phase of each cartridge P by engaging the member 24*b* of each cartridge P with an associated rotation-stopping portion 53*b* in the apparatus main assembly 2 side.

In this state, each of upper surface portions of the driving side and non-driving side cover members 24 and 25, in the drum unit 8 side, of each cartridge P is pressed by the pressing mechanism 80 (FIG. 3 in which the non-driving side is not illustrated). As a result, each cartridge P is sandwiched between the pressing mechanism 80 and the V-character portions 51*a* and 52*a*, thus being positionally fixed and held at a predetermined mounting position at the cartridge accommodating portion 2A inside the apparatus main assembly 2.

FIG. 19 shows a positioning method of a conventional cartridge Q in an apparatus main assembly. When the cartridge Q is mounted in the apparatus main assembly. A supporting member (tray) 165 is pulled out from the apparatus main assembly and then the cartridge Q is mounted on the supporting member 165. FIG. 19 shows a state in which the supporting member 165 on which the cartridge Q is mounted is inserted into the positioned in the apparatus main assembly.

The apparatus main assembly receives an arcuate portion 161*a* of a driving side cover member 161 and an arcuate portion of a non-driving side cover member of the cartridge Q by a V-character portion 163*a* of a driving side cartridge holder 163 and a V-character portion of a non-driving side cartridge holder of the apparatus main assembly. The cover member, the arcuate portion, the cartridge heater and the V-character portion which are provided in the non-driving side are not shown in FIG. 19. On the other hand, the apparatus main assembly is configured to receive the cartridge Q by engaging a projection 161*b* provided to the driving side cover member 161 of the cartridge Q with a groove 165*b* provided to the supporting member 165.

In the conventional embodiment, positioning of the cartridge Q was effected via the driving side cartridge holder 163 and the non-driving side cartridge holder which are a fixed member and via the supporting member 165 as a movable member. When the position of the supporting member 165 relative to the apparatus main assembly is derived, also the position of the cartridge Q, supported by the supporting member 165, relative to the apparatus main assembly is derived. In order to position the cartridge Q relative to the apparatus main assembly with high accuracy, there was a need to effect the positioning of the supporting member 165 relative to the apparatus main assembly with high accuracy.

Further, there was a need to control a dimension of the supporting member 165 with high accuracy, and particularly a metal plate was used as a part for forming the groove portion of the supporting member 165. As a result, a cost was increased.

The positioning of the cartridge P in this embodiment is, as described above, effected by the driving side and non-driving side cartridge holds 51 and 52 and the driving side main assembly side plate 53 which are fixed parts on the bottom plate 55 of the apparatus main assembly 2, and therefore the control of the positional accuracy is easy. Further, a rotation-stopping function for the cartridge P is imparted to the driving side main assembly side plate 53 and therefore different from the conventional embodiment, there is no need to use the metal plate as the supporting member 65, so that cost reduction can be realized.

(Shift Mechanism for Tray 70)

The shift(ing) mechanism for tray 70 will be described. Part (a) of FIG. 9 is a perspective view of a part of the apparatus main assembly 2 as seen from a right front side of the apparatus main assembly 2, and (b) of FIG. 9 is an exploded perspective view of a part of the apparatus main assembly 2. The apparatus main assembly 2 is provided with the opening 2B for permitting taking out and putting in of the tray 70 and the cartridge P. The door 3 is moved rotationally about the rotation center boss 3*a* as the (rotation) center and is provided to the apparatus main assembly 2 so as to be movable to an open position where the opening 2B is exposed and a closed position where the opening 2B is closed (covered). The door 3 is provided with a front door engaging boss 3*b* at a position different from the position of the boss 3*a*. The boss 3*b* engages with a front door engaging groove 72*a* of the link 72 provided in the apparatus main assembly 2.

The link 72 is supported movably in only the front-rear direction (arrow A direction: first direction) of the apparatus main assembly 2, e.g., by the guides 53*c* which are cut and erected from the driving side main assembly side plate 53. The front door engaging groove 72*a* of the link 72 is an elongated hole in the vertical (up-down) direction (arrow B direction: second direction) of the apparatus main assembly 2. Further, the link 72 is provided with a rail engaging groove 72*b* which is an elongated hole in the vertical direction (arrow B direction) of the apparatus main assembly 2. In the rail engaging groove 72*b*, a boss 73*a* of the rail 73 is engaged.

Here, the rail 73 is a guide for permitting taking out and putting in of the tray 70 with respect to the apparatus main assembly 2 in the front-rear direction (arrow A direction). Particularly, in order to facilitate a taking out and putting in operation of the tray 70, the rail 73 is provided with a rotatable roller 73*b*. Between the link 72 and the rail 73, the driving side main assembly side plate 53 is disposed.

Further, the driving side main assembly side plate 53 is provided with a crank groove 53*d*. The boss 73*a* of the rail 73 is engaged in the crank groove 53*d* of the driving side main assembly side plate 53. Also in the non-driving side of the apparatus main assembly 2, a shift mechanism including a link, a guide and the like which are similar to those described above is provided symmetrically with the above-described shift mechanism.

In the state in which the door 3 is closed, the front door engaging boss 3*b* is located rearward than the rotation center boss 3*a*. As a result, the driving side and non-driving side links 72 each having the front door engaging groove 72*a* engaged with the boss 3*a* are pushed rearward and are located at a retracted position. For that reason, the boss 73*a* of the rail 73 engaged with the rail engaging groove 72*b* of the link 72 is, as shown in (a) of FIG. 10A, moved to a rear end portion 53*d*-D which is a lower portion of the crank groove 53*d*. As a result, both of the driving side and non-driving side rails 73 are located and held at the lower portion as shown in (b) of FIG. 10A.

The tray 70 mounted on the rail 73 is, since the rail 73 is located and held at the lower portion, located at the lower portion with respect to the vertical direction in the cartridge accommodating portion 2A inside the apparatus main assembly 2. The position of the lower portion of the tray 70 is the first inside position (I).

In the state in which the tray 70 is located at the first inside position (I), each cartridge P accommodated in the associated small-frame portion 71 is received, at its arcuate portions 24*a* and 25*a*, by the V-character portions 51*a* and 52*a* in the apparatus main assembly 2 side ((b) of FIG. 10B). Further, the reverse U-character groove member 24*b* is engaged with the rotation-stopping portion 53*b* in the apparatus main assembly 2 side, thus being rotation-stopped ((b) of FIG. 10A).

The V-character portions 70*a* and 70*b* of the tray 70 are spaced from the bosses 24*c* and 25*c* in the cartridge P side ((b) of FIG. 10A and (a) of FIG. 10B). Further, the preventing surface 70*c* of the tray 70 is spaced from the projection 24*d* in the cartridge P side ((b) of FIG. 10B). That is, the tray 70 is not associated with each cartridge P in the state in which the tray 70 is located at the first inside position (I), so that the tray 70 does not support each cartridge P.

Further, in the state in which the tray 70 is located at the first inside position (I), each cartridge P is pressed, in the drum unit 8 side, from above by the pressing mechanism 80. As a result, each cartridge P is sandwiched between the pressing mechanism 80 and the V-character portions 51*a* and 52*a* and is positionally fixed and held at a predetermined mounting position at the cartridge accommodating portion 2A in the apparatus main assembly 2 side.

Further, to the couplings 4*a* and 42 of each cartridge P mounted at the mounting position, the couplings 91 and 92 as a drive output portion in the apparatus main assembly 2 side are connected, respectively. Further, an electric contact in the cartridge P side and an electric contact in the apparatus main assembly 2 side are electrically conducted. Further, a lower surface of the drum 4 of each cartridge P is contacted to the belt 12, so that the primary transfer portion is formed. In the above state, the apparatus 1 is capable of performing an image forming operation.

By opening the door 3 from the closed state, as described above, in an initial stage of the opening operation of the door 3, the apparatus main assembly-side couplings 91 and 92 perform a retraction operation from the couplings 4*a* and 42 of each cartridge P, thus releasing the coupling connection. The electric contact in the apparatus main assembly 2 side is retracted from the electric contact in the cartridge P side to eliminate the electric conduction. The pressing mechanism 80 performs a pressure-eliminating operation to eliminate the positioning fixation of each cartridge P.

Then, with a subsequent opening operation of the door 3, the front door engaging boss 3*b* is moved from the rearward position of the rotation center boss 3*a* frontward and upward with the boss 3*a* as the center. As a result, the driving side and non-driving side links 72 each having the front door engaging groove 72*a* engaged with the boss 3*a* are pulled frontward and are moved to an advancing position. For that reason, the boss 73*a* of the rail 73 engaged with the rail engaging groove 72*b* of the link 72 is, as shown in (a) of FIG. 11A, moved from the rear end portion 53*d*D which is the lower portion of the crank groove 53*d* to a front end portion 53*d*-D which is a higher portion.

As a result, both of the driving side and non-driving side rails 73 are moved forward and upward and in a state in which the door 3 is sufficiently opened to a predetermined open angle, the rails 73 are located and held at the higher portion, as shown in (b) of FIG. 11A, higher than the lower portion shown in (b) of FIG. 10A to a predetermined degree.

The tray 70 mounted on the rail 73 is, as described above, moved upward with the movement of the rail 73 from the lower portion to the higher portion and is located and held at the higher portion with respect to the vertical direction inside the apparatus main assembly 2. The position of the higher portion of the tray 70 is the second inside position (II).

In a state in which the tray 70 is located at the first inside position (I) and at the second inside position (II), the tray 70 is, as described later, locked in the apparatus main assembly side by a locking portion, thus being prevented from being moved frontward. Although the locking portion prevents the frontward movement of the tray 70, the locking portion is configured to permit the movement of the tray 70 in the up-down direction. For that reason, although the rail 73 is moved frontward and upward with the opening operation of the door 3 as described above, the tray 70 is prevented from being moved forward by the locking portion and is vertically raised from the first inside position (I) with the rise of the rail, thus being moved and held at the second inside position (II).

During the vertical rise of the tray 70 from the first inside position (I) to the second inside position (II), with the bosses 24*c* and 25*c* of each cartridge P, the corresponding (associated) V-character portions 70*a* and 70*b* of the tray 70 are engaged ((a) of FIG. 11B). Further, with the projection 24 of each cartridge P, the corresponding preventing surface 70*c* of the tray 70 is engaged ((b) of FIG. 11B). As a result, each cartridge P is in a state in which the cartridge P is stably supported by the tray 70 at the corresponding small-frame portion 71.

Further, by the rise of each cartridge P together with the tray 70 with further rise of the tray 70, the arcuate portions 24*c* and 25*c* of each cartridge P are raised and spaced from the corresponding V-character portions 51*a* and 52*a* in the apparatus main assembly 2 side ((b) of FIG. 11A and (c) of FIG. 11B). Further, the reversed U-character groove member 24*b* of each cartridge P is raised and spaced from the rotation-stopping portion 53*b* in the apparatus main assembly 2 side ((b) of FIG. 11A). Further, the lower surface of the drum 4 of each cartridge P is raised and spaced from the belt 12 ((b) of FIG. 11A).

The tray 70 is, in the state in which the door 3 is sufficiently opened to the predetermined open angle, placed in a state in which the tray 70 is moved to the second inside position (II) higher than the first inside position (I) to the predetermined degree, and is stably held.

With reference to FIGS. 12 and 13, the locking portion of the tray 70 will be described. Part (a) of FIG. 12 is a perspective view of the front frame portion of the tray 70 as seen from above, and (b) of FIG. 12 is a perspective view of the front frame portion of the tray 70 as seen from below. At the front frame portion of the tray 70, a supporting member locking portion (tray locking portion) 74, a holding (handle) portion 75 and a holding portion urging spring 76 are provided. The locking portion 74 and the holding portion 75 are configured to be interrelated with each other by engagement between a groove 74*a* of the locking portion 74 and a boss 75*a* of the holding portion 75. Further, the locking portion 74 is provided with a tapered surface 74*b* at its end portion. Further, the holding portion 75 is always urged toward the main assembly rear side (in an arrow N direction) by the heating portion urging spring 76.

Parts (a) to (d) of FIG. 13 are schematic views of the tray 70 as seen from above the apparatus main assembly 2. Part (a) of FIG. 13 shows a state (outside position) in which the tray 70 is pulled out from the apparatus main assembly 2, and the locking portion 74 is projected from a driving-side surface 70*d* of the front frame portion of the tray 70. When the tray 70 is inserted into the apparatus main assembly 2, as shown in (b) of FIG. 13, the tray 70 is contacted to, e.g., a projection 53*e* provided on the driving side main assembly side plate 53 but by using the tapered surface 74*b* of the locking portion 74, the locking portion 74 is retracted in an arrow J direction against the spring 76.

Part (c) of FIG. 13 shows a state in which the tray 70 is further inserted into the apparatus main assembly 2. The interference of the tray 70 with the projection 53*e* of the driving side main assembly side plate 53 is eliminated, so that the locking portion 74 is projected again from the tray side surface 70*d*. Here, the apparatus main assembly 2 is provided with a tray regulating spring 2C (FIGS. 3, 6 and 7) for applying an urging force to the tray 70 in a direction opposite to the arrow N direction.

Therefore, the tray 70 is inserted to the position of (c) of FIG. 13 by the user but is finally regulated at (limited to) a position where the locking portion 74 is contacted to the projection 53*e* of the driving side main assembly side plate 53. Part (d) of FIG. 13 shows a state in which the cartridge P is located at the second inside position (II), with respect to the apparatus main assembly 2, where the latent image formed on the drum 4 is not developed. The locking portion 74 and the projection 53*e* of the driving side main assembly side plate 53 are contacted at a vertical surface, so that the tray 70 is permitted to be moved in the up-down direction in a state in which the tray 70 is prevented from being moved frontward.

The holding portion 75 of the tray 70 moved to the second inside position (II) is moved in the direction opposite to the arrow N direction against the urging force of the spring 76 by the user, so that the locking portion 74 is moved in the arrow J direction ((b) of FIG. 13) and its contact with the projection 53*e* is eliminated. As a result, the user pulls out the tray 70 in an apparatus main assembly front direction (opposite to the arrow N direction) as described above to move the tray 70 to the outside position (III) outside the apparatus main assembly 2, so that the user can effect the exchange between the new and old cartridges.

FIG. 14 shows a supporting state of the cartridge P mounted on the tray 70 at the second inside position (II) or the outside position (III). FIG. 14 is, for convenience of explanation, shown as a partial sectional view of a part of the tray 70.

As described above, the tray 70 is provided with the V-character portions 70*a* and 70*b*, which are open upward, as the second positioning portions provided in the driving side and the non-driving side, respectively, correspondingly to each cartridge P. Further, correspondingly to each cartridge P, as the second preventing portion, the preventing surface 70*c* which is open upward is provided. When the cartridge P is inserted into the corresponding accommodating portion 71 of the tray 70 from above, the bosses 24*c* and

25*c* in the cartridge P side are engaged with the V-character portions 70*a* and 70*b* of the tray 70. Further, the projection 24*d* in the cartridge P side is contacted to the preventing surface 70*c* of the tray 70.

A force acting on the cartridge P on the tray 70 is only the gravity. Further, the gravity G of the cartridge P is located, with respect to the front-rear direction (arrow A direction: first direction) of the apparatus main assembly 2, between the bosses 24*c* and 25*c* as the rotation center and the projection 24*d* as the rotation-stopping portion. Therefore, the driving side and non-driving side bosses 24*c* and 25*c* in the cartridge P side are engaged into the driving side and non-driving side V-character portions 70*a* and 70*b*, respectively, so that the cartridge P is positioned on the tray 70 with high accuracy.

Part (a) of FIG. 15 shows a state in which the door 3 is opened and the tray 70 is located at the second inside position (II) inside the apparatus main assembly 2. Part (b) of FIG. 15 shows, for convenience of explanation, the cartridge P, the driving side cartridge holder 51 and a part of the driving side main assembly side plate 53. Part (a) of FIG. 16 shows a state in which the door 3 is partly moved toward the closed position, and (b) of FIG. 16 shows the cartridge P, the driving side cartridge holder 51 and a part of the driving side main assembly side plate 53 for convenience of explanation.

In FIG. 16, the door 3 is not sufficiently moved toward the closed position. With the movement of the door 3 from the open position to the closed position, the link 72 engaged with the front door engaging boss 3*b* is moved to the rear side of the apparatus main assembly 2 (in the arrow N direction). With this movement, also the rail 73 engaged with the rail engaging groove 72*b* is moved to the rear side of the apparatus main assembly 2 (in the arrow N direction).

Here, the boss 73*a* provided on the rail 73 is also engaged with the crank groove 53*d* of the driving side main assembly side plate 53 and therefore is moved also downward along the crank groove 53*d* in combination with the movement of the link 72 to the rear side of the apparatus main assembly 2 (in the arrow N direction). At this time, the tray 70 mounted on the rail 73 is, as described above, positionally prevented from being moved in the front-rear direction (arrow A direction) of the apparatus main assembly 2 by the engaging portion and as a result, the tray 70 is moved only downward.

With this lowering of the tray 70, also the cartridge P is moved downward relative to the apparatus main assembly 2. At this time, the arcuate portions 24*a* and 25*a* in the cartridge P side are configured to contact the V-character portions 51*a* and 52*a* in the apparatus main assembly 2 side. In FIGS. 15 and 16, only driving side parts are shown. Further, the member 24*b* in the cartridge P side is configured to be engaged with the rotation-stopping portion 53*b* which is cut and erected from the driving side main assembly side plate 53.

At an end portion of the member 24*b*, tapered portions 24*e* are provided as shown in FIG. 17 in order to lead the rotation-stopping portion 53*b* to the groove portion of the member 24*b*. An amount of the leading in consideration of a positional variation of the cartridge P on the tray 70 and a positional variation of the tray 70 with respect to the apparatus main assembly is required.

However, as shown in FIGS. 14 to 16, the first positioning portions 51*a* and 52*a* and the first preventing portion 53*b* are, in the state in which the tray 70 is located at the second inside position (II), located between the second positioning portions 70*a* and 70*b* and the second preventing portion 70*c* with respect to the first direction A.

That is, with respect to the first direction A, the arcuate portions 24*a* and 25*a* and the member 24*b* in the cartridge P side are located between the bosses 24*c* and 25*c* and the projection 24*d* in the cartridge P side, so that the cartridge P is supported by the tray 70 with high positional accuracy to the possible extent. Therefore, when the tray 70 is moved downward, the cartridge P can be smoothly positioned relative to the apparatus main assembly 2. Particularly, the member 24*b* and the rotation-stopping portion 53*b* can be smoothly engaged with each other.

Part (a) of FIG. 17 shows the case where there is a positional deviation amount m1 between the member 24*b* and the rotation-stopping portion 53*b*. In this case, in order to engage the member 24*b* and the rotation-stopping portion 53*b*, the member 24*b* is required to have a leading amount m1. Further, the cartridge P is required to have a raising and lowering amount m2.

On the other hand, (b) of FIG. 17 shows the case where there is a positional deviation amount n1 between the member 24*b* in the cartridge P side and the rotation-stopping portion 53*b*. Here, the positional deviation amount n1 is larger than the positional deviation amount m1. In this case, in order to engage the member 24*b* and the rotation-stopping portion 53*b*, the member 24*b* is required to have a leading amount n1. Further, a raising and lowering amount n2 of the cartridge P is required to be larger than the raising and lowering amount m2. That is, a height of the apparatus main assembly 2 is increased.

According to the positioning constitution of the cartridge P on the tray 70 in this embodiment, the tray 70 is provided with the V-character portions 70*a* and 70*b* and therefore the cartridge P is positioned on the tray 70 with high accuracy with no play. For that reason, at the end portions of the member 24*b* of the cartridge P, the tapered portions with a smaller leading amount may only be required. As a result, the raising and lowering amount of the cartridge P in the apparatus main assembly 2 can be made small, so that downsizing of the apparatus main assembly 2 can be realized.

Part (a) of FIG. 18 shows a state in which the door 3 is located at the closed position. When the door 3 is further closed from the state of FIG. 16, similarly as described above, the rail 73 and the tray 70 are moved downward. However, in the state of FIG. 16, the cartridge P has already been received, at its lower portion, by the driving side and non-driving side cartridge holders 51 and 52 and therefore is not further moved downward.

All of the V-character portions 70*a* and 70*b* and the preventing surface 70*c* of the tray 70 to be engaged with the bosses 24*c* and 25*c* and the projection 24*d* of the cartridge P, respectively, are open upward. For this reason, the tray can freely perform a downward movement position. As a result, the tray 70 is spaced from the cartridge P.

The constitutions of the image forming apparatus 1 and the cartridge P in the above-described embodiment are summarized as follows.

(1) The image forming apparatus 1 is an apparatus, to which the plurality of cartridges P (PY, PM, PC, PK) are detachably mountable, for forming the image on the recording material S. The apparatus 1 includes the supporting member 70 for supporting the plurality of cartridges P. The supporting member 70 pulls out the cartridges to the outside of the apparatus main assembly 2 of the image forming apparatus 1 and is capable of taking the outside position (III) where each cartridge P is detachably mountable.

Further, the supporting member 70 is capable of taking the first inside position (I) where the cartridges P are positioned relative to the apparatus main assembly 2 inside the apparatus main assembly 2. Further, the supporting member 70 is capable of taking the second inside position (II) located inside the apparatus main assembly 2 between the outside position (III) and the first inside position (I).

In the apparatus main assembly 2, the first positioning portions 51*a* and 52*a* and the first preventing portion 53*b* are provided. The first positioning portions 51*a* and 52*a* positions the cartridge P when the supporting member 70 is located at the first inside position (I). The first preventing portion 53*b* prevents the cartridge P from being rotated about the first positioning portions.

Further, in the apparatus main assembly 2, the second positioning portions 70*a* and 70*b* and the second preventing portion 70*b* are provided. The second positioning portions 70*a* and 70*b* positions the cartridge P when the supporting member 70 is located between the outside position (III) and the second inside position (II). The second preventing portion 70*c* prevents the cartridge P from being rotated about the second positioning portions. In order to position the supporting member 70 between the outside position (III) and the second inside position (II), the supporting member 70 may also be placed in a state in which the supporting member 70 is located at the outside position (III) and in a state in which the supporting member 70 is located at the second inside position (II).

Further, the second positioning portions 70*a* and 70*b* and the second preventing portion 70*c* are spaced from the cartridge P when the supporting member 70 is located at the first inside position (I).

(2) The direction A in which the supporting member 70 is moved between the outside position (III) and the second inside position (II) is the first direction. The direction B perpendicular to the first direction A is the second direction. The supporting member 70 passes, when the supporting member 70 is moved between the outside position (III) and the second inside position (II), between the first positioning portions 51*a* and 52*a* and the first preventing portion 53*b* with respect to the second direction B.

(3) The first positioning portions 51*a* and 52*a* and the first preventing portion 53*b* are, in the state in which the supporting member 70 is located at the second inside position (II), located between the second positioning portions 70*a* and 70*b* and the second preventing portion 70*c* with respect to the first direction A.

(4) The second positioning portions 70*a* and 70*b* and the second preventing portion 70*c* are located between the first positioning portions 51*a* and 52*a* and the first preventing portion 53*b* with respect to the second direction B>

(5) The cartridge P detachably mountable to the image forming apparatus 1 as described above includes the first portions-to-be-positioned 24*a* and 25*a* engageable with the first positioning portions 51*a* and 51*b* and includes the first portion-to-be-prevented 24*b* engaged with the first preventing portion 53*b*. Further, the cartridge P includes the second portions-to-be-positioned 24*c* and 25*c* engageable with the second positioning portions 70*a* and 70*b* and includes the second portion-to-be-prevented 24*c* engageable with the second preventing portion 70*c*.

(6) The cartridge P is a developing cartridge for developing the electrostatic latent image formed on the electrophotographic photosensitive member 4.

(7) The cartridge P includes the electrophotographic photosensitive member 4 and the process means acting on the electrophotographic photosensitive member 4.

(8) The first portions-to-be-positioned 24*a* and 25*a* are provided coaxially with the photosensitive drum as the electrophotographic photosensitive member.

(9) The gravity G of the cartridge P is provided between the second portions-to-be-positioned 24*a* and 25*a* and the second portion-to-be-prevented 24*c* with respect to the first direction A.

As described above, the cartridge P is provided with the arcuate portions (first portions-to-be-positioned) 24*a* and 25*a* and with the reversed U-character groove member (first preventing portion) 24*b* which are used for effecting positioning thereof relative to the tray 70 by itself in the apparatus main assembly 2. Further, the bosses (second portions-to-be-positioned) 24*c* and 25*c* and the projection (second portion-to-be-prevented) 24*d* which are used for effecting the position of the cartridge P relative to the tray 70 are provided.

Further, the tray (supporting member) 70 is provided with the V-character portions (second positioning portions) 70*a* and 70*b* for receiving the positioning bosses 24*c* and 25*c* of the cartridge P with respect to the tray 70. Further, the tray 70 is provided with the preventing surface (second preventing portion) 70*c* for receiving the projection 24*d* as the rotation-stopping portion of the cartridge P with respect to the tray 70.

As a result, the cartridge P is positioned on the tray 70 with high accuracy, so that the cartridge P can be demounted from and mounted into the apparatus main assembly 2. Further, the leading amount of the end portions of the member 24*b* as the rotation-stopping portion of the cartridge P can be made small and thus the raising and lowering amount of the cartridge P in the apparatus main assembly 2 can be made small. As a result, downsizing of the apparatus main assembly 2 can be realized.

Other Embodiments (1) In the above-described embodiment, the constitution in which the driving side cover member 24 and the driving side main assembly side plate 53 are engaged as the rotation phase determining means for the cartridge P was employed. The cartridge P is configured to receive a developing device drive output of the apparatus main assembly by providing the developing device driving coupling 42 at the driving side end portion of the cartridge P. It is important that the driving force transmitting portion is positioned with high accuracy. For that reason, it is preferable that the rotation phase determination for the cartridge P is effected in the driving side. However, the positioning (position determination) of the cartridge P is not limited to the above-described positioning but as the rotation phase determination means, a constitution in which the non-driving side cover member 25 and the non-driving side main assembly side plate 54 are engaged may also be employed.

(2) Further, in the above-described embodiment, as the cartridge P mounted to the apparatus main assembly 2, the integral type process cartridge prepared by integrally assembling the electrophotographic photosensitive member, the charging means, the cleaning means, the developing device and the like into the cartridge was described. The cartridge P is not limited thereto but may also be the discrete type process cartridge or the developing cartridge for developing the electrostatic latent image formed on the electrophotographic photosensitive member (image bearing member). The mounting of these cartridges to the apparatus main assembly 2 may also be effected by employing a similar constitution.

(3) Further, in the above-described embodiment, the full-color electrophotographic image forming apparatus to which the four cartridges are detachably mountable is described as the example. However, the number of the cartridges to be mounted to the apparatus is not limited to four but may be appropriately set. The present invention is applicable to the image forming apparatus to which a plurality of, i.e., two or more, cartridges are detachably mountable.

(4) The image forming apparatus is not limited to the printer as in the above-described embodiment. For example, the image forming apparatus may also be other image forming apparatuses such as the copying machine, the facsimile machine and the copying machine having the functions of these machines.

(5) The image forming process of the image forming apparatus is not limited to the electrophotographic process but may also be the electrostatic recording process using the electrostatic recording dielectric member as the image bearing member and the magnetic recording process using the magnetic recording member as the image bearing member.

As described above, according to the present invention, the positioning of the cartridge relative to the apparatus main assembly can be effected with high accuracy and at a low cost.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 240226/2011 filed Nov. 1, 2011, which is hereby incorporated by reference.

What is claimed is:

1. A cartridge detachably mountable to an image forming apparatus including a main assembly and a supporting member movable, in a state in which the supporting member detachably supports a cartridge, between a first position where the supporting member is positioned inside the main assembly and said cartridge is provided at an image formable position, and a second position retracted from the first position by being moved relative to the main assembly, wherein said cartridge comprises:

a supported portion for being supported by contacting with a supporting portion provided in the supporting member when the supporting member is in the second position; and a suppressed portion for suppressing rotation of said cartridge about said supported portion by engaging with a suppressing portion provided in the supporting member when the supporting member is in the second position, wherein when the supporting member is at the first position and said cartridge is positioned at the image formable position, said supported portion is spaced from the supporting portion and said suppressed portion is spaced from the suppressing portion.

2. A cartridge according to claim 1, further comprising a photosensitive member, wherein when the supporting member is in the first position, said photosensitive member contacts a transfer device provided in the main assembly, and when the supporting member is in the second position, said photosensitive member moves away from the transfer device.

3. A cartridge according to claim 1, wherein said supported portion is a projection projected along a longitudinal direction of said cartridge.

4. A cartridge according to claim 1, further comprising:

a photosensitive member;

a first frame for supporting said photosensitive member;

a developing roller for forming a developer image on said photosensitive member; and a second frame supporting said developing roller and swingable relative to said first frame, wherein said supported portion and said suppressed portion are provided on said first frame.

* * * * *